US010446985B2

(12) United States Patent
Ooi

(10) Patent No.: US 10,446,985 B2
(45) Date of Patent: Oct. 15, 2019

(54) ELECTRICAL CONNECTOR WITH SHIELD PLATE

(71) Applicant: HIROSE ELECTRIC CO., LTD., Tokyo (JP)

(72) Inventor: Tetsuya Ooi, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 90 days.

(21) Appl. No.: 15/856,796

(22) Filed: Dec. 28, 2017

(65) Prior Publication Data

US 2018/0198241 A1 Jul. 12, 2018

(30) Foreign Application Priority Data

Jan. 6, 2017 (JP) ..... 2017-000848

(51) Int. Cl.

| | |
|---|---|
| ***H01R 12/00*** | (2006.01) |
| ***H05K 1/00*** | (2006.01) |
| ***H01R 13/6585*** | (2011.01) |
| ***H01R 13/6471*** | (2011.01) |
| ***H01R 12/71*** | (2011.01) |
| ***H01R 12/73*** | (2011.01) |
| ***H01R 13/6597*** | (2011.01) |
| *H01R 13/405* | (2006.01) |

(52) U.S. Cl.

CPC ..... *H01R 13/6585* (2013.01); *H01R 12/716* (2013.01); *H01R 12/73* (2013.01); *H01R 13/6471* (2013.01); *H01R 13/6597* (2013.01); *H01R 13/405* (2013.01)

(58) Field of Classification Search

CPC ..... H01R 12/00; H01R 12/52; H01R 12/716; H01R 13/6585; H01R 13/405; H01R 13/6471

USPC ..... 439/74

See application file for complete search history.

(56) References Cited

U.S. PATENT DOCUMENTS

| | | | | |
|---|---|---|---|---|
| 6,250,935 | B1 * | 6/2001 | Mochizuki | H01R 13/658 439/74 |
| 6,764,315 | B2 * | 7/2004 | Ng | H01R 12/714 439/66 |
| 7,059,908 | B2 * | 6/2006 | Yamaguchi | H01R 13/6583 439/607.17 |
| 7,585,185 | B2 * | 9/2009 | Obikane | H01R 12/52 439/607.01 |
| 8,845,339 | B2 * | 9/2014 | Ono | H01R 12/7052 439/74 |
| 9,124,011 | B2 * | 9/2015 | Miyazaki | H01R 12/716 |
| 9,350,095 | B2 * | 5/2016 | Arichika | H01R 13/6271 |

(Continued)

FOREIGN PATENT DOCUMENTS

JP H08-321358 12/1996

*Primary Examiner* — Hae Moon Hyeon

(74) *Attorney, Agent, or Firm* — Rankin, Hill & Clark LLP

(57) ABSTRACT

There is provided a connector that can decrease a crosstalk generated between facing terminals by a shield plate in a case where at least one of a terminal adjacent to a first ground terminal and a terminal adjacent to a second ground terminal facing the first ground terminal functions as a signal terminal, by forming the shield plate so that one end of the shield plate is coupled to the first ground terminal arranged at each of both ends of one terminal group and the other end of the shield plate is coupled to the second ground terminal arranged at each of both ends of the other terminal group.

16 Claims, 12 Drawing Sheets

(56) References Cited

U.S. PATENT DOCUMENTS

| | | | | |
|---|---|---|---|---|
| 9,350,097 | B2 * | 5/2016 | Yunoki | H01R 12/716 |
| 2002/0055296 | A1 * | 5/2002 | Mochizuki | H01R 13/24<br>439/450 |
| 2006/0089018 | A1 * | 4/2006 | Orita | H01R 12/57<br>439/74 |

* cited by examiner

ELECTRICAL CONNECTOR WITH SHIELD PLATE

BACKGROUND OF THE INVENTION

1. Field of the Invention

The present invention relates to connectors for connection between substrates, and suitable for high-speed transmission of electric signals. Specifically, the present invention relates to a structure of a connector that, when the connector includes a plurality of terminals arrayed adjacently to one another at narrow pitches, can decrease occurrence of a crosstalk, which may be generated because of capacitance or induction between mutually facing terminals, and can appropriately maintain high-frequency characteristics such as impedance matching. In particular, the present invention relates to a configuration of a connector including a shield plate that can improve the high-frequency characteristics of a signal terminal arranged adjacently to a ground terminal.

2. Description of the Related Art

An example of related art to be used for transmitting electric signals etc. may be a connector described in Japanese Patent No. 3308132. In the connector of the related-art example, a plurality of terminals included in two terminal groups arrayed in lines are held at a rectangular housing by integral molding or another method. There is also provided a plug connector and a receptacle connector (socket connector) for connection between substrates (printed-circuit board, flexible flat cable, etc.).

In recent years, the performance of a data processing device mounted on an electronic apparatus, such as a measurement apparatus or an audiovisual (AV) apparatus, has been improved, and the electronic apparatus has been able to process a massive amount of data. Accordingly, the massive amount of data, as electric signals, has been transmitted and received at high speed via a connector connecting such substrates.

Also, as the size of a mobile terminal such as a smartphone is reduced and the function of the mobile terminal is increased, a demand for high-density mounting of parts, such as elements and connectors, on a printed-circuit board is further increased, and the size of a connector and the pitch between terminals in a connector are progressively reduced. In this situation, to appropriately transmit high-frequency electric signals, there is requested a connector having desirable high-frequency characteristics that may decrease disturbance of impedance matching etc. which may be generated between a plurality of terminals.

For example, in the connector described in Japanese Patent No. 3308132, a shield plate is arranged between one terminal group and the other terminal group, to decrease occurrence of a crosstalk which may be generated because of capacitance or induction between signal terminals that form a pair during differential transmission and to decrease an adverse effect on impedance matching.

However, even with the connector including the shield plate like the above-described related-art example, when electric signals are transmitted at further high speed, the adverse effect on impedance matching due to occurrence of a crosstalk between mutually facing terminals cannot be sufficiently prevented, and it is difficult to maintain appropriate high-frequency characteristics. Also, the shield plate included in the connector has a bottom surface (mount portion) that is mounted on a substrate and fixed to the substrate, and the bottom surface protrudes outside side walls of a housing of the connector. Hence, the shield plate disturbs the high-density mounting of parts such as a connector on the substrate and disturbs the reduction in size of the connector. Further, since the shield plate is used in addition to the plurality of terminals having the same shape included in the terminal groups, the number of parts increases, and handling of the parts may be troublesome work when the connector is manufactured.

SUMMARY OF THE INVENTION

To address the above-described problems, in a connector including a first terminal group including a plurality of terminals arrayed in a long-side direction at one side, a second terminal group including a plurality of terminals arrayed in the long-side direction at the other side, first ground terminals arranged at both ends of the array of the first terminal group, second ground terminals arranged at both ends of the array of the second terminal group, and an insulating housing that holds the first terminal group, the first ground terminals, the second terminal group, and the second ground terminals; by forming a shield plate arranged between the first terminal group and the second terminal group so that one end of the shield plate is coupled to at least one of the first ground terminals and the other end of the shield plate is coupled to at least one of the second ground terminals; in a case where at least one of a terminal adjacent to the first ground terminal arranged at one side and a terminal adjacent to the second ground terminal facing the first ground terminal functions as a signal terminal; the signal terminal is adjacent to one of the first ground terminals and the second ground terminals, and a crosstalk between the signal terminal and a terminal facing the signal terminal is decreased by the shield plate that functions as a ground by being coupled to at least one of the first ground terminals and the second ground terminals is decreased; and hence there is provided a connector that can improve high-frequency characteristics of the signal terminal, decrease occurrence of an electrically adverse effect such as a crosstalk which may be generated due to a decrease in pitch, and appropriately maintain impedance matching.

Also, since the shield plate is coupled to at least one of the first ground terminals and the second ground terminals, there is provided a connector that can decrease the number of parts, does not have to be provided with a mount portion extending outside side walls of a housing for connecting the shield plate with a substrate, and that can attain high-density mounting of parts such as a connector and reduction in size of such parts.

According to an embodiment of the present invention, a connector includes a first terminal group including a plurality of terminals; a second terminal group including a plurality of terminals; a first ground terminal; a second ground terminal; a housing that is made of insulating resin and that holds the first terminal group, the first ground terminal, the second terminal group, and the second ground terminal; and a shield plate arranged between the first terminal group and the second terminal group. The plurality of terminals included in the first terminal group are arrayed in a long-side direction of the housing at one side, and the first ground terminal includes a plurality of first ground terminals arranged at both ends with the first terminal group interposed therebetween. The plurality of terminals included in the second terminal group are arrayed in the long-side direction of the housing at the other side, and the second ground terminal includes a plurality of second ground terminals arranged at both ends with the second terminal group interposed therebetween. The shield plate is coupled to at least one of the first ground terminals and the second ground terminals via a coupling portion.

In a preferable embodiment of the connector according to the present invention, a cross-sectional shape of a terminal included in the first terminal group when cut in a short-side direction of the housing is the same as a cross-sectional shape of each of the first ground terminals when cut in the short-side direction; and a cross-sectional shape of a terminal included in the second terminal group when cut in the short-side direction of the housing is the same as a cross-sectional shape of each of the second ground terminals when cut in the short-side direction.

In a preferable embodiment of the connector according to the present invention, the first terminal group, the first ground terminals, the second terminal group, the second ground terminals, the shield plate, and the coupling portion are formed by integrally molding with the housing.

In a preferable embodiment of the connector according to the present invention, the shield plate includes two shield plates arranged in the long-side direction between the first terminal group and the second terminal group.

In a preferable embodiment of the connector according to the present invention, a first shield plate of the two shield plates is coupled to at least one of the first ground terminals, and a second shield plate of the two shield plates is coupled to at least one of the second ground terminals.

In a preferable embodiment of the connector according to the present invention, both the two shield plates are coupled to the first ground terminals or the second ground terminals.

In a preferable embodiment of the connector according to the present invention, the shield plate is a single shield plate arranged in the long-side direction between the first terminal group and the second terminal group.

In a preferable embodiment of the connector according to the present invention, one end of the shield plate is coupled to at least one of the first ground terminals, and the other end of the shield plate is coupled to at least one of the second ground terminals.

In a preferable embodiment of the connector according to the present invention, both ends of the shield plate are coupled to the first ground terminals or the second ground terminals.

In a preferable embodiment of the connector according to the present invention, the connector further includes a plurality of reinforcing portions arranged at side walls in a short-side direction of the housing. The reinforcing portion provided at one of the side walls is coupled to the first ground terminal at one side via a coupling portion. The reinforcing portion provided at the other one of the side walls is coupled to the second ground terminal at the other side via a coupling portion. The first ground terminal and the second ground terminal coupled to the reinforcing portions are not coupled to the shield plate.

According to another embodiment of the present invention, a connector includes a first terminal group including a plurality of terminals; a second terminal group including a plurality of terminals; a first ground terminal; a second ground terminal; a housing that is made of insulating resin and that holds the first terminal group, the first ground terminal, the second terminal group, and the second ground terminal; a shield plate arranged between the first terminal group and the second terminal group; and a reinforcing portion arranged at a side wall in a short-side direction of the housing. The plurality of terminals included in the first terminal group are arrayed in a long-side direction of the housing at one side, and the first ground terminal includes a plurality of first ground terminals arranged at both ends with the first terminal group interposed therebetween. The plurality of terminals included in the second terminal group are arrayed in the long-side direction of the housing at the other side, and the second ground terminal includes a plurality of second ground terminals arranged at both ends with the second terminal group interposed therebetween. The reinforcing portion includes a plurality of reinforcing portions provided at side walls extending in the short-side direction of the housing. The shield plate is coupled to each of the reinforcing portions via a coupling portion.

In a preferable embodiment of the connector according to the present invention, each of the reinforcing portions is coupled to the first ground terminal and the second ground terminal adjacent to the reinforcing portion, via a coupling portion.

In a preferable embodiment of the connector according to the present invention, a cross-sectional shape of a terminal included in the first terminal group when cut in the short-side direction of the housing is the same as a cross-sectional shape of each of the first ground terminals when cut in the short-side direction; and a cross-sectional shape of a terminal included in the second terminal group when cut in the short-side direction of the housing is the same as a cross-sectional shape of each of the second ground terminals when cut in the short-side direction.

In a preferable embodiment of the connector according to the present invention, the first terminal group, the first ground terminals, the second terminal group, the second ground terminals, the shield plate, the reinforcing portions, and the coupling portions are formed by integrally molding with the housing.

In a preferable embodiment of the connector according to the present invention, the shield plate provides complete separation or partial separation between the plurality of terminals included in the first terminal group and the plurality of terminals included in the second terminal group.

In a preferable embodiment of the connector according to the present invention, the shield plate is embedded in a fitting protrusion that is formed at a center portion to extend in the long-side direction of the housing.

In a preferable embodiment of the connector according to the present invention, at least one of a terminal adjacent to the first ground terminal arranged at one side and a terminal adjacent to the second ground terminal facing the first ground terminal functions as a signal terminal.

In a preferable embodiment of the connector according to the present invention, a terminal adjacent to the first ground terminal arranged at one side functions as a signal terminal, and a terminal adjacent to the second ground terminal facing the first ground terminal functions as a ground terminal.

With the connector according to any of the embodiments of the present invention, by forming the shield plate arranged between the first terminal group and the second terminal group to be coupled to the first ground terminal arranged at an end of the array of the first terminal group and the second ground terminal arranged at an end of the array of the second terminal group; in the case where at least one of the terminal adjacent to the first ground terminal and the terminal adjacent to the second ground terminal facing the first ground terminal functions as the signal terminal; a crosstalk which may be generated between the signal terminal and a terminal facing the signal terminal can be blocked by the shield plate that functions as the ground by being coupled to the first ground terminal or the second ground terminal. Accordingly, the high-frequency characteristics of the terminal that functions as the signal terminal can be improved, occurrence of an electrically adverse effect such as a crosstalk which may be generated because of capacitance or induction between mutually facing terminals can be decreased, and impedance matching can be appropriately maintained.

Also, since the shield plate is coupled to at least one of the first ground terminals and the second ground terminals, the number of parts can be decreased, the mount portion extending outside the side walls of the housing for connecting the shield plate with the substrate does not have to be provided, the high-density mounting and size reduction of parts such as a connector can be attained, occurrence of an electrically adverse effect such as a crosstalk which may be generated because of capacitance or induction between mutually facing terminals can be decreased, and impedance matching can be appropriately maintained.

DESCRIPTION OF THE PREFERRED EMBODIMENTS

Embodiments of the present invention will be described below with reference to the drawings. In all the drawings for explaining the embodiments, the same reference signs are basically applied to the same members and the redundant description thereof is omitted. Also, the embodiments are independently described; however, it is not intended to eliminate to configure a connector by combining components of the embodiments.

Figure 1:
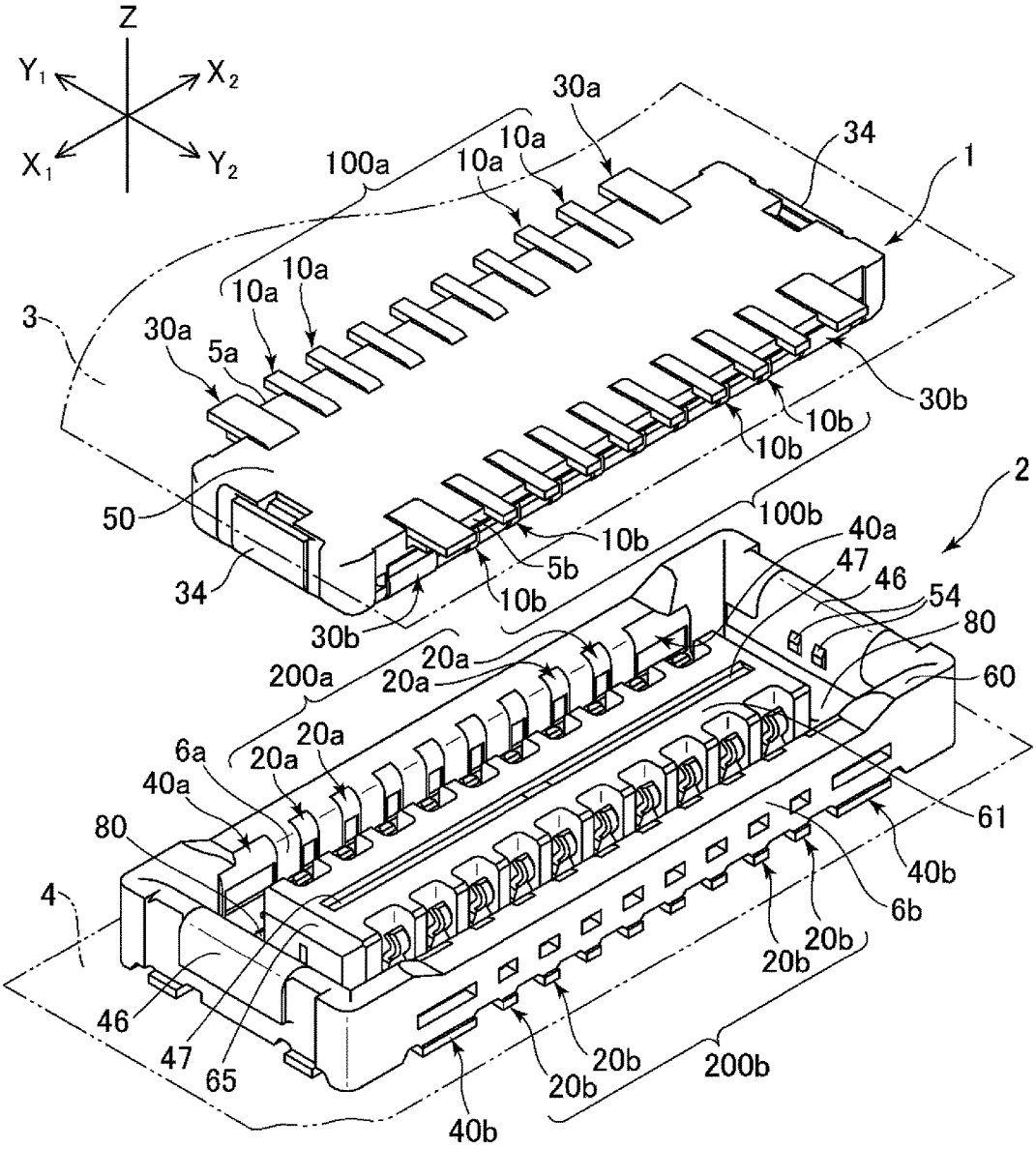
FIG. 1 illustrates an external appearance of a connector system including a receptacle connector and a plug connector according to an embodiment of the present invention.

FIG. 1 illustrates an external appearance of a connector system including a receptacle connector and a plug connector according to an embodiment of the present invention. In FIG. 1, it is assumed that a fitting direction of the connectors is a Z-axis direction, a long-side direction of the connectors is an X-axis direction, and a short-side direction of the connectors is a Y-axis direction. The definition of the directions is also applied to FIGS. 2 to 12. It is assumed that, in the fitting direction (Z-axis direction) of the connectors, a plug connector 1 side is an upper side, and a receptacle connector 2 side is a lower side. Also, it is assumed that, in the long-side direction (X-axis direction), one side is an $X_1$ side, and the other side is an $X_2$ side.

This connector system can be used as an internal part of a small electronic apparatus, such as a cellular phone, a smartphone, a digital camera, or a laptop personal computer. In FIG. 1, reference signs "10*a*," "10*b*," "20*a*," or "20*b*" to partial terminals among a plurality of terminals included in each of the plug connector 1 and the receptacle connector 2, and the reference signs of the other terminals having the same shapes as those with the reference signs are omitted. The plug connector 1 is mounted on a substrate 3 indicated by broken lines. The receptacle connector 2 is mounted on a substrate 4 indicated by broken lines. In an example illustrated in FIG. 1, the substrate 3 is a flexible flat cable, and the substrate 4 is a printed-circuit board. However, the substrates 3 and 4 are not limited to those of the example. In this case, an object on which a connector is mounted, such as a printed-circuit board or a flexible flat cable, is merely called "substrate."

The plug connector 1 and the receptacle connector 2 are formed by shaping housings made of insulating resin into rectangular shapes. The plug connector 1 includes a first terminal group 100*a* including a plurality of terminals 10*a* arrayed at a first side wall 5*a* extending in the long-side direction (X-axis direction) of a housing 50; and a first ground terminal 30*a*. The plug connector 1 also includes a second terminal group 100*b* including a plurality of terminals 10*b* arrayed at a second side wall 5*b* extending in the long-side direction (X-axis direction) of the housing 50; and a second ground terminal 30*b*. The receptacle connector 2 includes a first terminal group 200*a* including a plurality of terminals 20*a* arrayed at a first side wall 6*a* extending in the long-side direction (X-axis direction) of a housing 60; and a first ground terminal 40*a*. The receptacle connector 2 also includes a second terminal group 200*b* including a plurality of terminals 20*b* arrayed at a second side wall 6*b* extending in the long-side direction (X-axis direction) of the housing 60; and a second ground terminal 40*b*.

The rectangular-shaped plug connector 1 can hold the plurality of terminals 10*a* and 10*b* with the same shape that are arrayed at uniform intervals at the first side wall 5*a* and the second side wall 5*b* on both sides extending in the long-side direction (X-axis direction). Also, the plug connector 1 can hold a plurality of the first ground terminals 30*a* at the first side wall 5*a*, and hold a plurality of the second ground terminals 30*b* at the second side wall 5*b*. The plurality of first ground terminals 30*a* can be arranged at positions adjacent to the array of the plurality of terminals 10*a* arrayed in the long-side direction at uniform intervals. The plurality of second ground terminals 30*b* are configured likewise. Further, the plug connector 1 may be provided with reinforcing portions 34 at side walls extending in the short-side direction (Y-axis direction). The reinforcing portions 34 are formed of an electrically conductive member such as metal, to protect the side walls of the housing 50 when the plug connector 1 is fit to the receptacle connector 2 that is a counterpart connector.

While two first ground terminals 30*a* are arranged at positions adjacent to both ends of the array of the plurality of terminals 10*a* included in the first terminal group 100*a* with the array of the plurality of terminals 10*a* interposed between the first ground terminals 30*a*, at the one ($Y_1$-side) side wall 5*a* of the housing 50 according to the embodiment of the present invention, a single first ground terminal 30*a* may be arranged at at least one of ends of the array of the plurality of terminals 10*a*. The other ($Y_2$-side) side wall 5*b* of the housing 50 may be configured likewise. Also, while the reinforcing portions 34 are provided at both side walls extending in the short-side direction (Y-axis direction) of the housing 50, a single reinforcing portion 34 may be provided at only one of the side walls, and the reinforcing portion 34 may be even omitted if the housing 50 has a sufficient strength.

The rectangular-shaped receptacle connector 2 has a fitting protrusion 61 formed in a ridge shape in the long-side direction (X-axis direction) at a center portion of the housing 60, and has a fitting recess 80 formed in a groove shape to surround the fitting protrusion 61. The fitting protrusion 61 and the fitting recess 80 of the receptacle connector 2 are respectively fit to a fitting recess 51 (see FIG. 3) and side walls that include the first side wall 5*a* and the second side wall 5*b* surrounding the fitting recess 51 and that may serve as a fitting protrusion of the plug connector 1. The fitting protrusion 61 may be provided with a tapered portion 65 at an upper portion of an edge portion extending in the short-side direction (Y-axis direction) of the fitting protrusion 61. The tapered portion 65 allows the fitting protrusion 61 to be smoothly fit to the fitting recess 51 (see FIG. 3) of the plug connector 1.

A shield plate 47 formed of an electrically conductive member such as metal can be embedded in the fitting protrusion 61 to be arranged to provide separation between the first terminal group 200*a* being one terminal group and the second terminal group 200*b* being the other terminal group and between the first ground terminal 40*a* being one ground terminal and the second ground terminal 40*b* being the other ground terminal. The embedded shield plate 47 can be configured not to protrude above an upper surface of the fitting protrusion 61, and can be exposed from an opening provided at the upper surface of the fitting protrusion 61. While the opening is provided at the upper surface of the fitting protrusion 61 along the embedded shield plate 47 according to the embodiment of the present invention, the opening may not be provided if the shield plate 47 does not have to be exposed. The shield plate may be held at the housing by press fitting to the fitting protrusion of the housing or integral molding with the fitting protrusion.

The receptacle connector 2 can hold the plurality of terminals 20*a* with the same shape that are arrayed at uniform intervals at the first side wall 6*a* extending in the long-side direction (X-axis direction), and can likewise hold the plurality of terminals 20*b* with the same shape that are arrayed at uniform interval at the second side wall 6*b* extending in the long-side direction (X-axis direction). Also, the receptacle connector 2 can hold the plurality of first ground terminals 40*a* at the first side wall 6*a* extending in the long-side direction (X-axis direction), and can likewise hold the plurality of second ground terminals 40*b* at the second side wall 6*b* extending in the long-side direction (X-axis direction).

The plurality of first ground terminals 40*a* can be arranged at positions adjacent to the array of the plurality of terminals 20*a* arrayed in the long-side direction (X-axis direction) at uniform intervals. Likewise, the plurality of second ground terminals 40*b* can be arranged at positions adjacent to the array of the plurality of terminals 20*b* arrayed in the long-side direction (X-axis direction) at uniform intervals. Further, the receptacle connector 2 can be provided with reinforcing portions 46 at side walls extending in the short-side direction (Y-axis direction). The reinforcing portions 46 are formed of an electrically conductive member such as metal, to protect the side walls extending in the short-side direction (Y-axis direction) of the housing 60 when the receptacle connector 2 is fit to the plug connector 1 that is a counterpart connector. The reinforcing portions 46 can have lock portions 54 for fixing the fitting state with the plug connector 1, at side surfaces facing the fitting protrusion 61.

While the two first ground terminals 40*a* are arranged at the positions adjacent to both ends of the array of the plurality of terminals 20*a* included in the first terminal group 200*a*, at the one ($Y_1$-side) side wall 6*a* of the housing 60 according to the embodiment of the present invention, a single first ground terminal 40*a* may be arranged at at least one end of the array of the plurality of terminals 20*a*. The other ($Y_2$-side) side wall 6*b* of the housing 60 may be configured likewise. Also, while the reinforcing portions 46 are provided at both side walls extending in the short-side direction (Y-axis direction) of the housing 60, a single reinforcing portion 46 may be provided at only one of the side walls, and the reinforcing portion 46 may be even omitted if the housing 60 has a sufficient strength.

Figure 2:
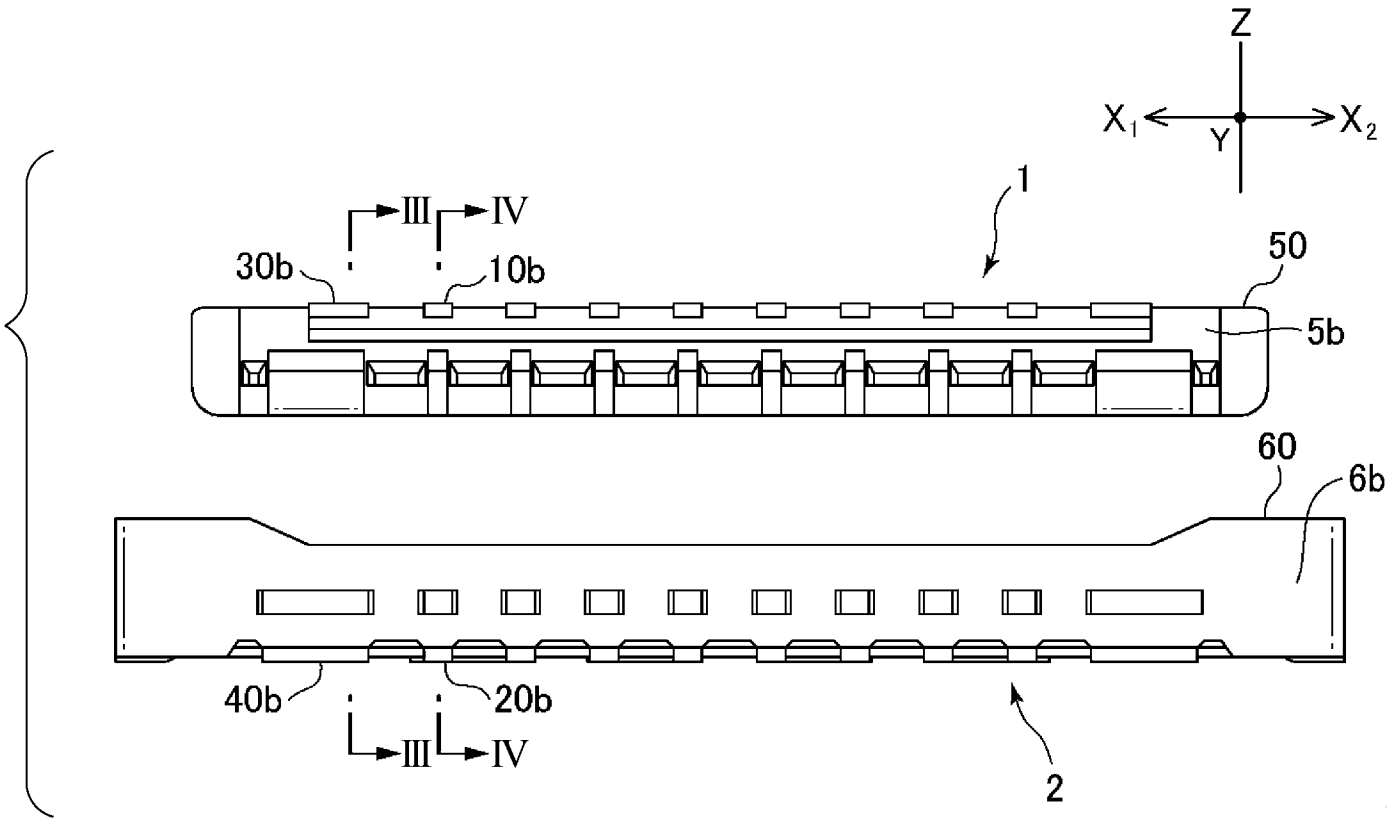
FIG. 2 is a side view illustrating a side surface of the connector system including the receptacle connector and the plug connector according to the embodiment of the present invention.
Figure 3:
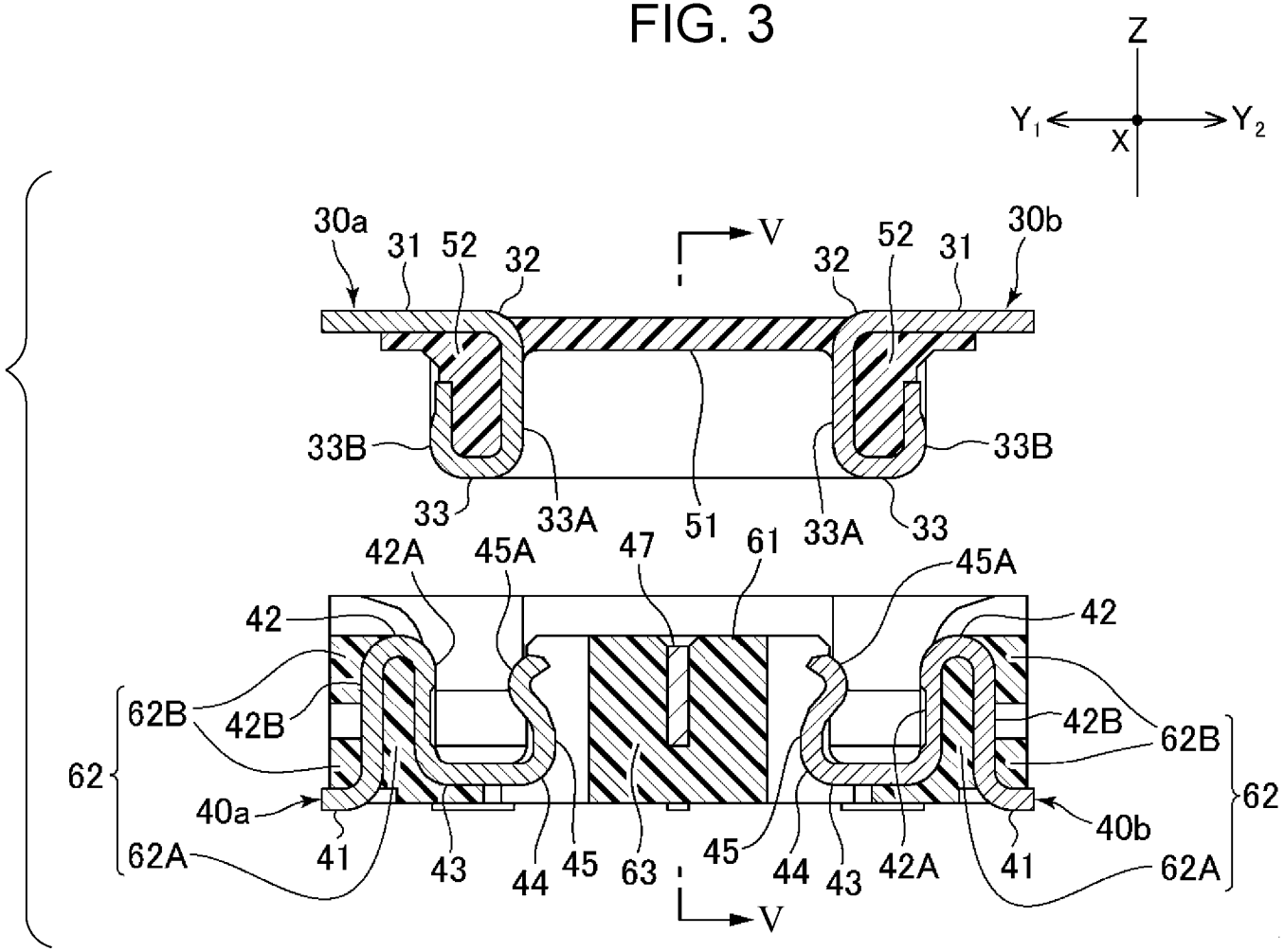
FIG. 3 is a cross-sectional view when the connector system is perpendicularly cut along line III-III in FIG. 2.
Figure 4:
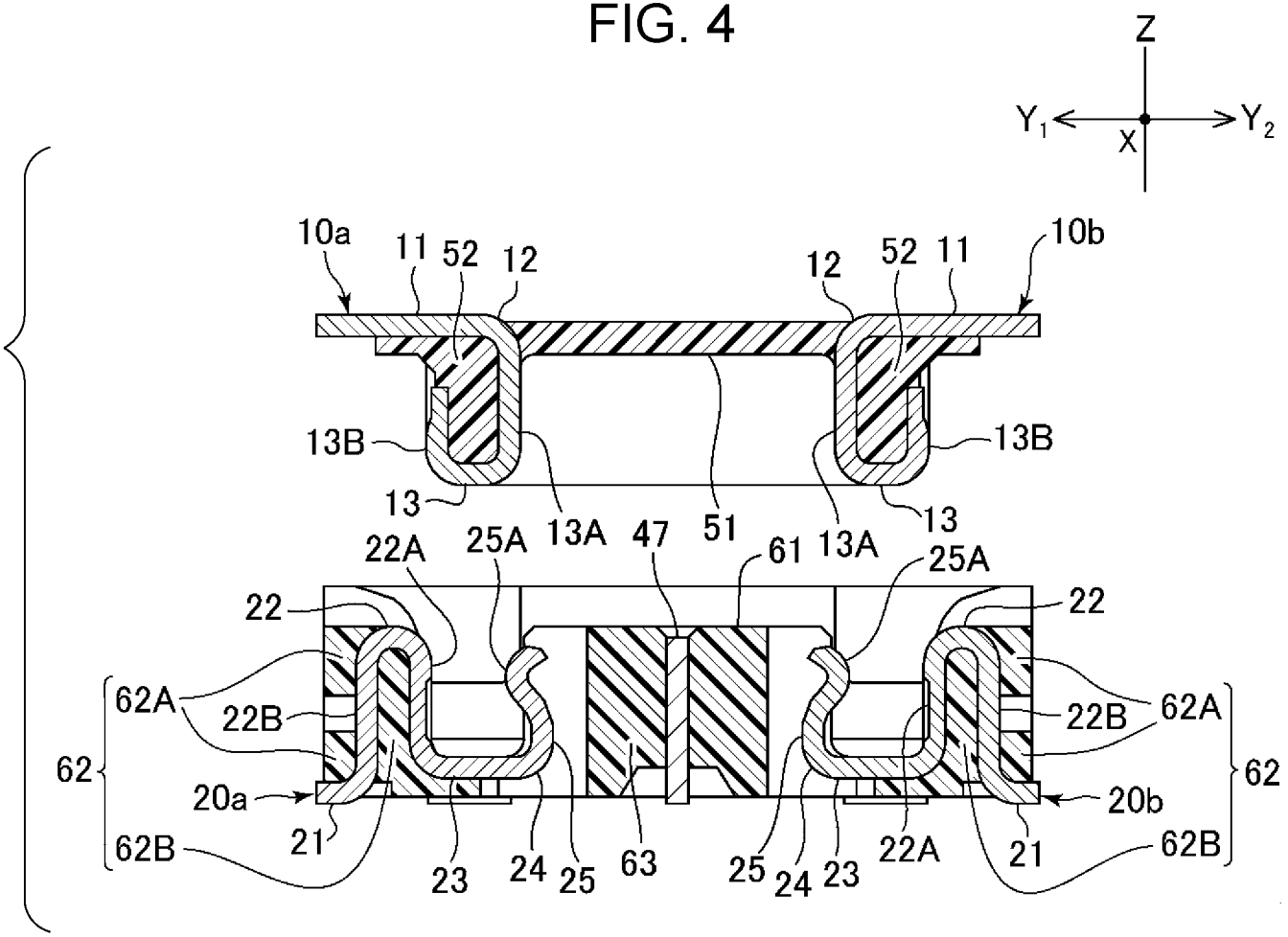
FIG. 4 is a cross-sectional view when the connector system is perpendicularly cut along line IV-IV in FIG. 2.

FIG. 2 is a side view illustrating a side surface of the connector system including the receptacle connector and the plug connector according to the embodiment of the present invention. FIG. 3 is a cross-sectional view when the housing 50 and the housing 60 are perpendicularly cut along line III-III in the short-side direction (Y-axis direction) illustrated in FIG. 2 from a portion provided with a second ground terminal 30*b* of the plug connector 1 and a second ground terminal 40*b* of the receptacle connector 2 facing the second ground terminal 30*b*. Also, FIG. 4 is a cross-sectional view when the housing 50 and the housing 60 are perpendicularly cut along line IV-IV in the short-side direction (Y-axis direction) illustrated in FIG. 2 from a portion provided with a terminal 10*b* of the plug connector 1 and a terminal 20*b* of the receptacle connector 2 facing the terminal 10*b*.

Referring to the cross-sectional view of FIG. 3, the housing 50 of the plug connector 1 has the fitting recess 51 at the center portion. The first ground terminal 30*a* or the second ground terminal 30*b* can be provided at a holding wall 52 that is a portion of the first side wall 5*a* or the second side wall 5*b*. The first ground terminal 30*a* or the second ground terminal 30*b* of the plug connector 1 includes a fitting-in portion 33 being a portion curved in a U shape, a shift portion 32 being bent, and a connection portion 31. The U-shaped fitting-in portion 33 has two legs at mutually facing positions. One of the two legs of the fitting-in portion 33 is a leg 33A (hereinafter, referred to as "inner leg 33A") located at a fitting recess 51 side. The first ground terminal 30*a* or the second ground terminal 30*b* extends outward (toward $Y_1$ side or $Y_2$ side) in the short-side direction (Y-axis direction) of the plug connector 1 from the inner leg 33A via the shift portion 32. The connection portion 31 is mounted on the substrate 3 (connected by soldering). As illustrated in FIGS. 1 and 3, the first ground terminal 30*a* and the second ground terminal 30*b* are held by the holding walls 52 by integral molding or another method with the first side wall 5*a* and the second side wall 5*b* extending in the long-side direction (X-axis direction) of the plug connector 1, at the fitting-in portion 33 and the shift portion 32.

The fitting-in portion 33 is embedded in the holding wall 52 being a portion of the first side wall 5*a* or the second side wall 5*b* extending in the long-side direction of the plug connector 1 so that the fitting-in portion 33 extends along the holding wall 52 from the lower side. An inner plate surface and a side edge of the U-shaped portion of the fitting-in portion 33 are held by the holding wall 52. An outer plate surface of the U-shaped portion exposed from the holding wall 52 is located to define the same plane as a surface at the inner side (the fitting recess 51 side) of the first side wall 5*a* or the second side wall 5*b*.

The fitting-in portion 33 has a contact portion (not illustrated) formed in a recessed shape or a protruding shape at a plate surface of the inner leg 33A at the fitting recess 51 side. The contact portion can contact a contact portion 45A of a terminal 20 of the receptacle connector 2 with a contact pressure in a fitting state with the receptacle connector 2. The fitting-in portion 33 also has the other leg 33B (hereafter, referred to as "outer leg 33B"). A plate surface of the outer leg 33B located outside the fitting recess 51 is formed as a protruding contact portion that is engaged with a recessed contact portion 42A-1 (see FIG. 7) formed at a plate surface of an outer leg 42A of a ground terminal 40 of the receptacle connector 2.

As illustrated in the cross-sectional view of FIG. 3, the first ground terminal 30*a* and the second ground terminal 30*b* each are held at the holding wall 52, being a portion of the first side wall 5*a* or the second side wall 5*b* extending in the long-side direction (X-axis direction) of the plug connector 1, by covering the holding wall 52 with the U-shaped fitting-in portion 33 including the connection portion 31, the shift portion 32, the inner leg 33A, and the outer leg 33B. Hence, the area between the inner leg 33A and the outer leg 33B, that is, the inside of the fitting-in portion 33 has resin therein or is filled with resin.

The first ground terminal 40*a* and the second ground terminal 40*b* of the receptacle connector 2 each include a fit-in portion 43 being a portion curved in a U shape, a held portion 42 having an inverted U shape, and a connection portion 41. The fit-in portion 43 has two legs including an elastic leg (hereinafter, referred to as "inner leg 45") extending in the up-down direction at a fitting protrusion 61 side and having a free end, and a leg (hereinafter, referred to as "outer leg 42A") that is coupled to the held portion 42 held at a holding wall 62 being a portion of the first side wall 6*a* or the second side wall 6*b* of the receptacle connector 2. The held portion 42 shares the outer leg 42A of the U-shaped fit-in portion 43 as one of legs thereof, and has a leg (hereinafter, referred to as "outer leg 42B") located outside the outer leg 42A as the other leg thereof. The connection portion 41 extends outward (toward $Y_1$ side or $Y_2$ Side) in the short-side direction (Y-axis direction) of the receptacle connector 2 from the outer leg 42B, and is mounted on the substrate (connected by soldering).

As illustrated in FIGS. 1 and 3, the first ground terminal 40*a* and the second ground terminal 40*b* each are held at the fit-in portion 43, the held portion 42, and the outer legs 42A and 42B by integral molding or another method with the first side wall 6*a* or the second side wall 6*b* extending in the long-side direction of the receptacle connector 2. The held portion 42 is embedded in the holding wall 62 being a portion of the first side wall 6*a* or the second side wall 6*b* so that the held portion 42 extends along the holding wall 62 from the upper side. An outer (back) plate surface and a side edge of the outer leg 42A of the fit-in portion 43 are held by the holding wall 62. An inner plate surface of the U-shaped portion exposed from the holding wall 62 is located to define the same plane as a surface at the inner side (the fitting protrusion 61 side) of the first side wall 6*a* or the second side wall 6*b*.

Referring to the cross-sectional view of FIG. 3, the first ground terminal 40*a* and the second ground terminal 40*b* each are held by the holding wall 62 being a portion of the first side wall 6*a* or the second side wall 6*b* extending in the long-side direction of the receptacle connector 2 in such a manner that the outer leg 22B is embedded in the holding wall 62. That is, the outer leg 42B is arranged between a main holding wall 62A and a sub-holding wall 62B. The held portion 42 having the inverted U shape including the outer leg 42B and the outer leg 42A is held to extend along the main holding wall 62A. Hence, the area between the outer leg 42B and the outer leg 42A has resin therein or is filled with resin.

The fitting protrusion 61 includes a separation wall 63 between the inner leg 45 of the first ground terminal 40*a* and the inner leg 45 of the second ground terminal 40*b* facing each other in the short-side direction (Y-axis direction). The shield plate 47 is arranged at the center of the separation wall 63 in the short-side direction (Y-axis direction) and extends in the long-side direction (X-axis direction). The shield plate 47 may provide complete separation between the inner leg 45 of the first ground terminal 40*a* and the inner leg 45 of the second ground terminal 40*b* facing each other. However, since an electric signal is not transferred between the first ground terminal 40*a* and the second ground terminal 40*b* like the embodiment of the present invention, the shield plate 47 for reducing occurrence of a crosstalk between terminals facing each other in the short-side direction (Y-axis direction) may be configured to provide partial separation between the inner leg 45 of the first ground terminal 40*a* and the inner leg 45 of the second ground terminal 40*b* facing each other. Alternatively, the shield plate 47 may be omitted. A shift portion 44, the inner leg 45, and the contact portion 45A formed by bending a tip end portion of the inner leg 45 extending from a bottom portion of the fit-in portion 43 define a free end that does not contact the separation wall 63 of the fitting protrusion 61 in a normal state.

The terminal 10*a*, the terminal 10*b*, the terminal 20*a*, and the terminal 20*b* have configurations like those of the first ground terminal 30*a*, the second ground terminal 30*b*, the first ground terminal 40*a*, and the second ground terminal 40*b*. Referring to the cross-sectional view of FIG. 4, the terminal 10*a* or the terminal 10*b* can be provided at the holding wall 52 being a portion of the first side wall 5*a* or the second side wall 5*b*. The terminal 10*a* or the terminal 10*b* includes a fitting-in portion 13 being a portion curved in a U shape, a shift portion 12 being bent, and a connection portion 11. The U-shaped fitting-in portion 13 has two legs formed at mutually facing positions of the fitting-in portion 13. One of the two legs of the fitting-in portion 13 is a leg 13A (hereinafter, referred to as "inner leg 13A") located at the fitting recess 51 side. The terminal 10*a* or the terminal 10*b* extends outward (toward $Y_1$ side or $Y_2$ side) in the short-side direction (Y-axis direction) of the plug connector 1 from the inner leg 13A via the shift portion 12. The connection portion 11 is mounted on the substrate (connected by soldering). As illustrated in FIGS. 1 and 4, the terminal 10*a* and the terminal 10*b* are held by the holding wall 52 by integral molding or another method with the first side wall 5*a* and the second side wall 5*b* extending in the long-side direction (X-axis direction) of the plug connector 1, at the fitting-in portion 13 and the shift portion 12.

The fitting-in portion 13 is embedded in the holding wall 52 being a portion of the first side wall 5*a* or the second side wall 5*b* extending in the long-side direction of the plug connector 1 so that the fitting-in portion 13 extends along the holding wall 52 from the lower side. An inner plate surface and a side edge of the U-shaped portion of the fitting-in portion 13 are held by the holding wall 52. An outer plate surface of the U-shaped portion of the fitting-in portion 13 exposed from the holding wall 52 is located to define the same plane as a surface at the inner side (the fitting recess 51 side) of the first side wall 5*a* or the second side wall 5*b*.

The fitting-in portion 13 has a contact portion (not illustrated) formed in a recessed shape or a protruding shape at a plate surface of the inner leg 13A at the fitting recess 51 side. The contact portion can contact a contact portion 25A of a terminal 20 of the receptacle connector 2 with a contact pressure in a fitting state with the receptacle connector 2. The fitting-in portion 13 also has the other leg 13B (hereafter, referred to as "outer leg 13B"). A plate surface of the outer leg 13B located outside the fitting recess 51 is formed as a protruding contact portion that is engaged with a recessed contact portion 22A-1 (see FIG. 7) formed at a plate surface of an outer leg 22A of a terminal 20 of the receptacle connector 2.

As illustrated in the cross-sectional view of FIG. 4, the terminal 10*a* and the terminal 10*b* each are held at the holding wall 52 being a portion of the first side wall 5*a* or the second side wall 5*b* extending in the long-side direction (X-axis direction) of the plug connector 1, by covering the holding wall 52 with the U-shaped fitting-in portion 13 including the connection portion 11, the shift portion 12, the inner leg 13A, and the outer leg 13B. Hence, the area between the inner leg 13A and the outer leg 13B, that is, the inside of the fitting-in portion 13 has resin therein or is filled with resin.

The terminal 20*a* and the terminal 20*b* of the receptacle connector 2 each include a fit-in portion 23 being a portion curved in a U shape, a held portion 22 having an inverted U shape, and a connection portion 21. The fit-in portion 23 has two legs including an elastic leg (hereinafter, referred to as "inner leg 25") extending in the up-down direction and having a free end at the fitting protrusion 61 side, and a leg (hereinafter, referred to as "outer leg 22A") that is coupled to the held portion 22 held by the holding wall 62 being a portion of the first side wall 6*a* or the second side wall 6*b* of the receptacle connector 2. The held portion 22 shares the outer leg 22A of the U-shaped fit-in portion 23 as one of legs thereof, and has a leg (hereinafter, referred to as "outer leg 22B") located outside the outer leg 22A as the other leg thereof. The connection portion 21 extends outward (toward $Y_1$ side or $Y_2$ side) in the short-side direction (Y-axis direction) of the receptacle connector 2 from the outer leg 22B, and is mounted on the substrate (connected by soldering).

As illustrated in FIGS. 1 and 4, the terminal 20*a* and the terminal 20*b* each are held at the fit-in portion 23, the held portion 22, and the outer legs 22A and 22B by integral molding or another method with the first side wall 6*a* or the second side wall 6*b* extending in the long-side direction of the receptacle connector 2. The held portion 22 is embedded in the holding wall 62 being a portion of the first side wall 6*a* or the second side wall 6*b* so that the held portion 22 extends along the holding wall 62 from the upper side. An outer (back) plate surface and a side edge of the outer leg 22A of the fit-in portion 23 are held by the holding wall 62. An inner plate surface of the U-shaped portion exposed from the holding wall 62 is located to define the same plane as a surface at the inner side (the fitting protrusion 61 side) of the first side wall 6*a* or the second side wall 6*b*.

Referring to the cross-sectional view of FIG. 4, the terminal 20*a* and the terminal 20*b* each are held by the holding wall 62 being a portion of the first side wall 6*a* or the second side wall 6*b* extending in the long-side direction of the receptacle connector 2 in such a manner that the outer leg 22B is embedded in the holding wall 62. That is, the terminal 20*a* and the terminal 20*b* each are held in such a manner that the outer leg 22B is arranged between the main holding wall 62A and the sub-holding wall 62B, and the held portion 22 having the inverted U shape including the outer leg 22B and the outer leg 22A extends along the main holding wall 62A. Hence, the area between the outer leg 22B and the outer leg 22A has resin therein or is filled with resin.

The fitting protrusion 61 includes the separation wall 63 between the inner leg 25 of the terminal 20*a* and the inner leg 25 of the terminal 20*b* facing each other in the short-side direction (Y-axis direction). The shield plate 47 is arranged at the center of the separation wall 63 in the short-side direction (Y-axis direction) and extends in the long-side direction (X-axis direction). The shield plate 47 can provide complete separation between the inner leg 25 of the terminal 20*a* and the inner leg 25 of the terminal 20*b* facing each other. Among the plurality of terminals 20*a* and terminals 20*b* facing each other in the short-side direction (Y-axis direction) in the first terminal group 200*a* and the second terminal group 200*b*, the terminal 20*a* and the terminal 20*b* that are not used for high-speed transmission of electric signals almost do not generate an electrically adverse effect such as a crosstalk. Therefore, the shield plate does not have to provide complete separation between the inner leg 25 of the terminal 20*a* and the inner leg 25 of the terminal 20*b* facing each other like the embodiment of the present invention. The shield plate 47 may be configured to provide partial separation between the inner legs 25 facing each other, or the shield plate 47 may not be provided between the inner leg 25 of the terminal 20*a* and the inner leg 25 of the terminal 20*b* that are not used for high-speed transmission. A shift portion 24, the inner leg 25, and the contact portion 25A formed by bending a tip end portion of the inner leg 25 extending from a bottom portion of the fit-in portion 23 define a free end that does not contact the separation wall 63 of the fitting protrusion 61 in a normal state.

As illustrated in the cross-sectional views of FIGS. 3 and 4, the cross-sectional shapes of the terminal 10*a* and the first ground terminal 30*a* of the plug connector 1 are the same. Likewise, the cross-sectional shapes of the terminal 10*b* and the second ground terminal 30*b* of the plug connector 1 are the same. Also, the cross-sectional shapes of the terminal 20*a* and the first ground terminal 40*a* of the receptacle connector 2 are the same. Likewise, the cross-sectional shapes of the terminal 20*b* and the second ground terminal 40*b* of the receptacle connector 2 are the same.

Figure 5:
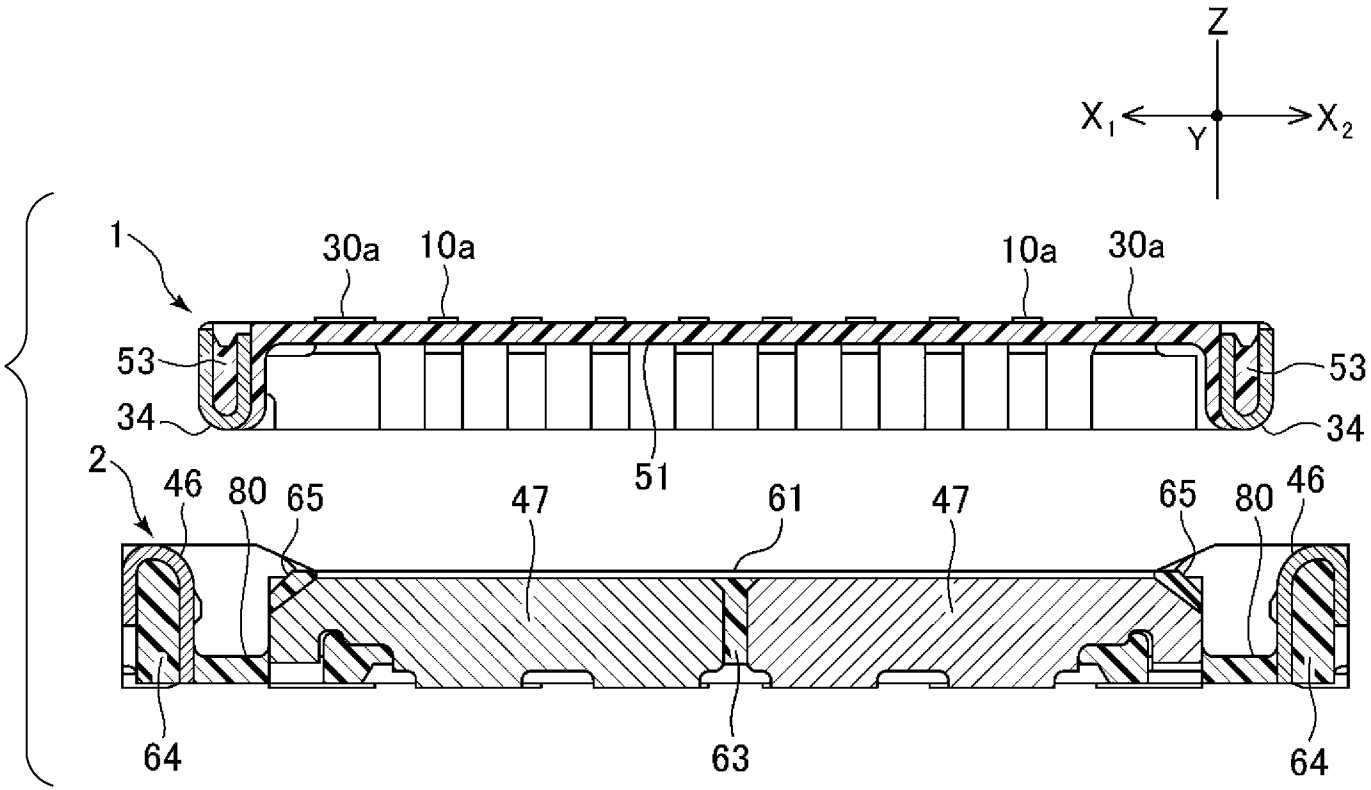
FIG. 5 is a cross-sectional view when the connector system illustrated in FIG. 2 is perpendicularly cut along line V-V in FIG. 3.

FIG. 5 is a cross-sectional view when the plug connector 1 and the receptacle connector 2 are perpendicularly cut in the long-side direction (X-axis direction) along line V-V in the long-side direction illustrated in FIG. 3. According to the embodiment of the present invention, the shield plate 47 is embedded in the fitting protrusion 61. An upper end of the shield plate 47 located at the upper side in the fitting direction (Z-axis direction) can be located at a constant height in parallel to the upper surface of the fitting protrusion 61. As illustrated in FIGS. 3 to 5, while the shield plate 47 does not protrude above the upper surface of the fitting protrusion 61 in the embodiment of the present invention, it is not limited to this embodiment. An upper end portion of the shield plate 47 may protrude above the upper surface of the fitting protrusion 61 if the plug connector 1 can be fit to the receptacle connector 2.

Also, the shield plate 47 may have at least one hole (through hole) extending therethrough in a plate thickness direction (Y-axis direction) according to another example. When the housing 60 including the fitting protrusion 61 and so forth is formed of insulating resin by integral molding, the resin enters the through hole provided in the shield plate 47 and fills the through hole. That is, since the through hole is filled with the insulating resin of the housing 60, the shield plate 47 can be further firmly held at the fitting protrusion 61 of the housing 60. Also, the terminal 20*a* and the terminal 20*b* facing each other with the through hole of the shield plate 47 arranged therebetween may generate a crosstalk because the separation between the terminals is not complete separation. Hence, such terminals can be used for purposes other than transmission of electric signals (for grounding etc.) instead of being used as signal terminals for high-speed transmission of electric signals.

The reinforcing portions 34 are provided at the side walls extending in the short-side direction of the plug connector 1. Also, the reinforcing portions 46 are provided at the side walls extending in the short-side direction of the receptacle connector 2. The reinforcing portions 34 can be integrally molded with the housing 50. Likewise, the reinforcing portions 46 can be integrally molded with the housing 60. The reinforcing portions 34 are formed in U shapes to sandwich holding walls 53 and hence are held at the holding walls 53. The reinforcing portions 46 are formed in U shapes to sandwich holding walls 64 and hence are held at the holding walls 64. Corner portions at the fitting recess 80 side in the long-side direction (X-axis direction) of the shield plate 47 are formed in an inclined manner similarly to the tapered portions 65 so that the corner portions do not protrude outward from the surfaces of the tapered portions 65. When the plug connector 1 is connected to the receptacle connector 2, the first side wall 5*a*, the second side wall 5*b*, and the reinforcing portions 34 of the plug connector 1 function as a fitting protrusion, and are fit to the fitting recess 80 of the receptacle connector 2.

At this time, the inclined surfaces of upper portions of the reinforcing portions 46 of the receptacle connector 2 and the inclined surfaces of the tapered portions 65 can smoothly guide the reinforcing portions 34 of the plug connector 1 into the fitting recess 80. Also, the reinforcing portions 34 and the reinforcing portions 46 reinforce the side walls extending in the short-side direction (Y-axis direction) of the plug connector 1 and the receptacle connector 2, and hence can prevent the side walls from being broken or chipped at connection between the connectors.

Figure 6:
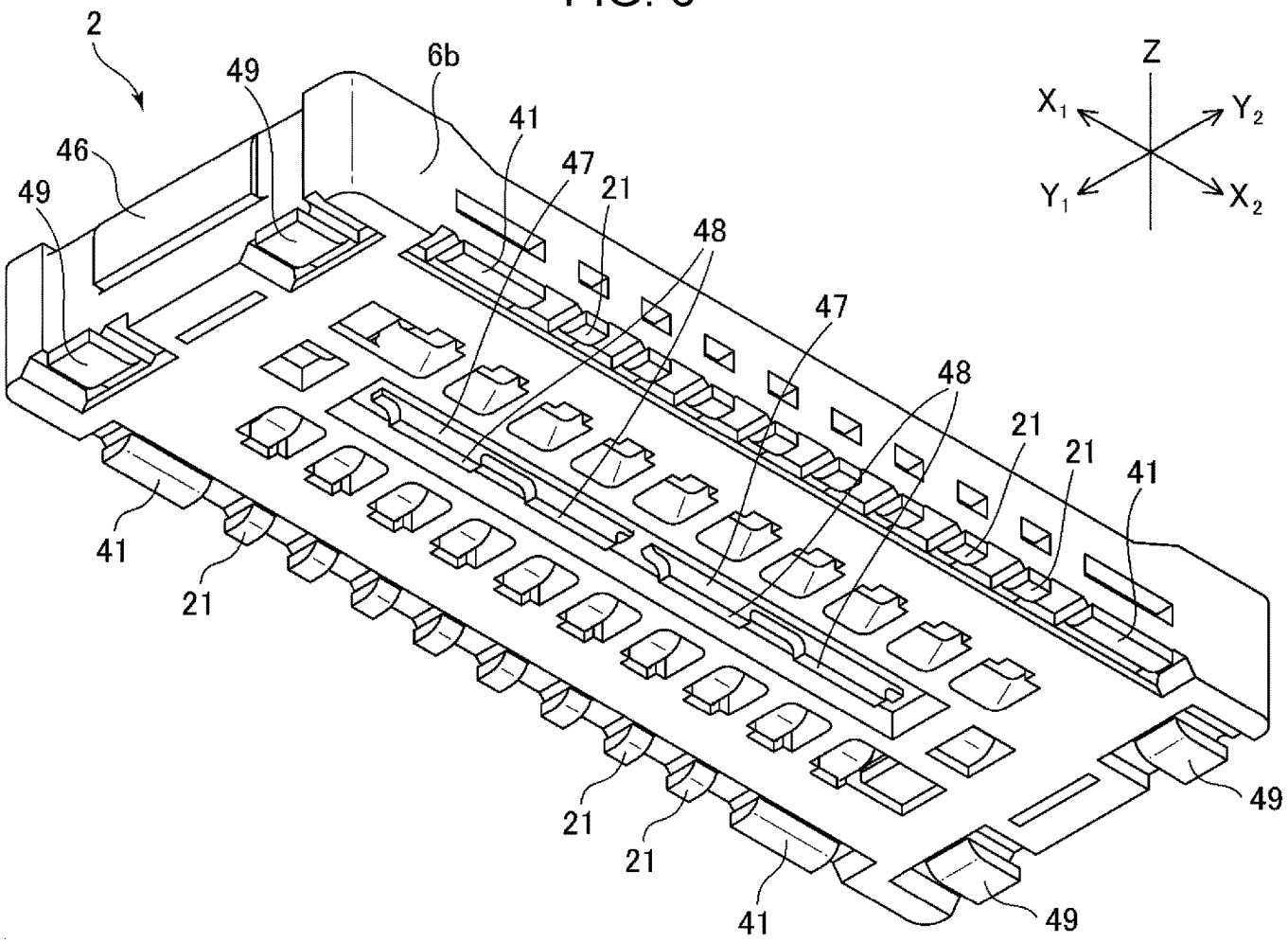
FIG. 6 illustrates a bottom surface of the receptacle connector according to the embodiment of the present invention.

FIG. 6 illustrates a bottom surface of the receptacle connector according to the embodiment of the present invention. The bottom surface of the shield plate 47 can be exposed from a center portion extending in the long-side direction (X-axis direction) of the bottom surface of the receptacle connector 2. A connection portion 48 is formed at the bottom surface of the shield plate 47 so that the shield plate 47 can be mounted on the substrate 4 (connected by soldering). Also, the connection portion 21 of the terminal 20 and the connection portion 41 of the ground terminal 40 can be mounted on the substrate 4. Further, the reinforcing portion 46 can be provided with a connection portion 49 configured to be mounted on the substrate 4.

Figure 7:
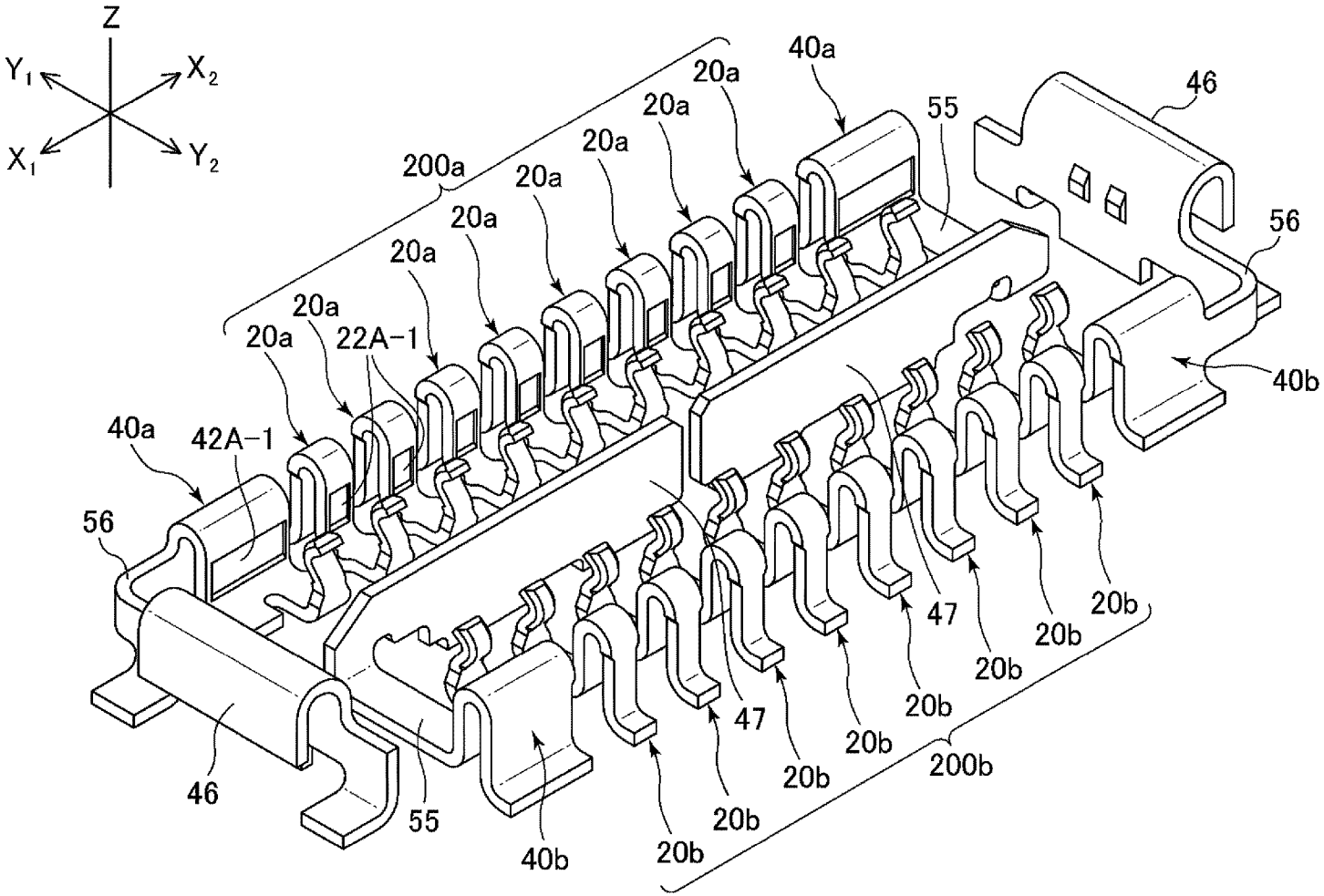
FIG. 7 is a perspective view illustrating terminal groups, ground terminals, shield plates, and so forth, according to the embodiment of the present invention.
Figure 8:
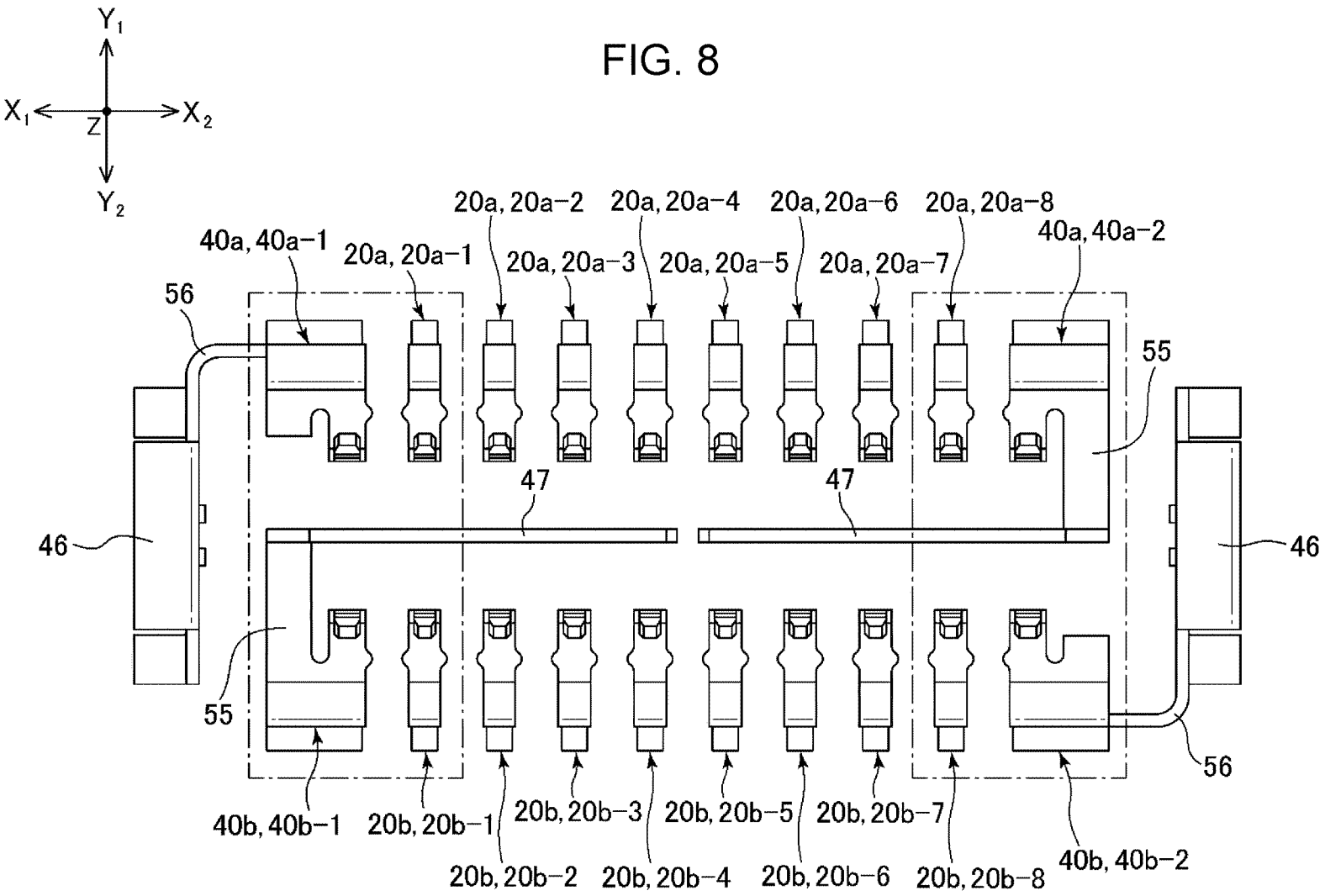
FIG. 8 is a top view illustrating the terminal groups, the ground terminals, the shield plates, and so forth, illustrated in FIG. 7.

FIG. 7 is a perspective view illustrating the terminal groups, the ground terminals, the shield plates, and so forth, according to the embodiment of the present invention. FIG. 8 is a top view illustrating the terminal groups, the ground terminals, the shield plates, and so forth, illustrated in FIG. 7. These drawings illustrate the appearance of the terminal groups, the ground terminals, the shield plates, and so forth, with the housing 60 of the receptacle connector 2 removed. As illustrated in FIG. 7, the contact portion 22A-1 having a recessed shape is formed at a plate surface of the outer leg 22A of the terminal 20, and the contact portion 42A-1 having a recessed shape is formed at a plate surface of the outer leg 42A of the ground terminal 40.

As illustrated in FIG. 8, the terminals of the first terminal group 200*a* and the first ground terminals 40*a* are numbered from one side ($X_1$ side) toward the other side ($X_2$ side) in the long-side direction (X-axis direction) sequentially as a first ground terminal 40*a*-1, a terminal 20*a*-1 to a terminal 20*a*-8, and a first ground terminal 40*a*-2; and the terminals of the second terminal group 200*b* and the second ground terminals 40*b* are numbered from one side ($X_1$ side) toward the other side ($X_2$ side) in the long-side direction (X-axis direction) sequentially as a second ground terminal 40*b*-1, a terminal 20*b*-1 to a terminal 20*b*-8, and a first ground terminal 40*b*-2.

The first shield plate 47 of the two shield plates 47 can be coupled to the first ground terminal 40*a*-1 or the second ground terminal 40*b*-1 via a coupling portion 55 that extends in a bottom portion of the housing 60. The second shield plate 47 can be coupled to the second ground terminal 40*b*-2 or the first ground terminal 40*a*-2 via a coupling portion 55 likewise. In the embodiment illustrated in FIG. 8, the shield plate 47 at the one side ($X_1$ side) is coupled to the second ground terminal 40*b*-1 via the coupling portion 55, and the shield plate 47 at the other side ($X_2$ side) is coupled to the first ground terminal 40*a*-2 via the coupling portion 55 likewise. That is, the shield plate, the coupling portion, and the ground terminal are integrally configured, and can be formed by punching a sheet metal and then bending the sheet metal. Also, the residual first ground terminal 40*a*-1 and second ground terminal 40*b*-2 not coupled to the shield plate 47 are coupled to the reinforcing portions 46 via coupling portions 56 formed along corner portions of side walls of the housing 60.

Also, the shape of members including the shield plate 47 at the one side ($X_1$ side), the coupling portion 55, and the second ground terminal 40*b*-1 is the same as the shape of members including the shield plate 47 at the other side ($X_2$ side), the coupling portion 55, and the first ground terminal 40*a*-2. Likewise, the shape of members including the first ground terminal 40*a*-1 at the one side ($X_1$ side), the coupling portion 56, and the reinforcing portion 46 is the same as the shape of members including the second ground terminal 40*b*-2 at the other side ($X_2$ side), the coupling portion 56, and the reinforcing portion 46. Accordingly, the number of types of parts that configure the receptacle connector 2 can be decreased.

The coupling target of the shield plate 47 is not limited to that according to the embodiment illustrated in FIGS. 7 and 8. The shield plate 47 at the one side ($X_1$ side) may be coupled to at least one of the first ground terminal 40*a*-1 and the second ground terminal 40*b*-1 at the one side ($X_1$ side), and the shield plate 47 at the other side ($X_2$ side) can be coupled to at least one of the first ground terminal 40*a*-2 and the second ground terminal 40*b*-2 at the other side ($X_2$ side). For example, the two shield plates 47 can be coupled to the first ground terminals 40*a* (40*a*-1 and 40*a*-2) at the same side or the second ground terminals 40*b* (40*b*-1 and 40*b*-2) at the same side; and the second ground terminals 40*b* (40*b*-1 and 40*b*-2) or the first ground terminals 40*a* (40*a*-1 and 40*a*-2) not coupled to the two shield plates 47 and located at the opposite side can be coupled to the reinforcing portions 46.

Regarding the first ground terminal 40*a*-1 and the second ground terminal 40*b*-1 at the one side ($X_1$ side) and the terminal 20*a*-1 and the terminal 20*b*-1 adjacent thereto enclosed by dotted lines in FIG. 8, when the terminal 20*a*-1 and the terminal 20*b*-1 both function as signal terminals, occurrence of a crosstalk between the signal terminal 20*a*-1 and the signal terminal 20*b*-1 facing each other can be decreased by the shield plate 47 coupled to the second ground terminal 40*b*-1. Consequently, the high-frequency characteristics of the signal terminal 20*a*-1 and the signal terminal 20*b*-1 can be improved. Also, even when at least one of the terminal 20*a*-1 and the terminal 20*b*-1 functions as a signal terminal, occurrence of a crosstalk of the signal terminal is decreased by the shield plate 47 coupled to the second ground terminal 40*b*-1, and the high-frequency characteristics can be improved. For example, when the terminal 20*a*-1 adjacent to the first ground terminal 40*a*-1 functions as a signal terminal, and when the terminal 20*b*-1 adjacent to the second ground terminal 40*b*-1 facing the first ground terminal 40*a*-1 functions as a ground terminal, occurrence of a crosstalk of the signal terminal is decreased by the first ground terminal 40*a*-1 and the shield plate 47, and the high-frequency characteristics can be improved. Regarding also the first ground terminal 40*a*-2 and the second ground terminal 40*b*-2 at the other side ($X_2$ side) and the terminal 20*a*-8 and the terminal 20*b*-8 adjacent thereto enclosed by other dotted lines, when such terminals have similar functions, similar advantageous effects can be obtained.

Further, when the terminal 20*a*-1 and the terminal 20*b*-1 both function as signal terminals, and when the terminal 20*a*-2 and the terminal 20*b*-2 both function as ground terminals, the signal terminal 20*a*-1 is arranged between the first ground terminal 40*a*-1 and the ground terminal 20*a*-2, and the signal terminal 20*b*-1 is arranged between the second ground terminal 40*b*-1 and the ground terminal 20*b*-2. In addition, a crosstalk between the signal terminal 20*a*-1 and the signal terminal 20*b*-1 facing each other can be blocked by the shield plate 47 that functions as a ground by being coupled to the second ground terminal 40*b*-1. Consequently, in particular, the high-frequency characteristics of the signal terminal 20*a*-1 and the signal terminal 20*b*-1 can be improved, occurrence of an electrically adverse effect such as a crosstalk, which may be generated because of capacitance or induction between mutually facing terminals can be decreased, and high-frequency characteristics such as impedance matching can be appropriately maintained. In particular, when coaxial signals function as signals of the terminal 20*a*-1 and the terminal 20*b*-1, the high-frequency characteristics of these terminals can be improved. Regarding also the first ground terminal 40*a*-2 and the second ground terminal 40*b*-2 at the other side ($X_2$ side) and the terminal 20*a*-8 and the terminal 20*b*-8 adjacent thereto enclosed by other dotted lines, when such terminals have similar functions, similar advantageous effects can be obtained.

For another example, when the terminal 20*a*-1 functions as a signal terminal, the terminal 20*a*-2 functions as a ground terminal, the terminal 20*b*-1 functions as a signal terminal, the terminal 20*b*-2 functions as a signal terminal, and the terminal 20*b*-3 functions as a ground terminal, in the configuration of the terminals at the one side ($X_1$ side) enclosed by dotted lines illustrated in FIG. 8, the signal terminal 20*a*-1 is arranged between the first ground terminal 40*a*-1 and the ground terminal 20*a*-2, and the shield plate 47 that functions as a ground by being coupled to the second ground terminal 40*b*-1 is provided. Accordingly, occurrence of a crosstalk with respect to the facing signal terminal 20*b*-1 can be decreased. Also, regarding the signal terminal 20*b*-1, with the shield plate 47 that functions as a ground by being coupled to the second ground terminal 40*b*-1, occurrence of a crosstalk with respect to the facing signal terminal 20*a*-1 can be decreased. In particular, when a coaxial signal is caused to function as a signal of the terminal 20*a*-1, and a differential signal is caused to function as a pair of signals of the terminal 20*b*-1 and the terminal 20*b*-2, the high-frequency characteristics of these terminals can be particularly improved. Also at the other side ($X_2$ side) enclosed by other dotted lines, when the configuration is similar to that of the above-described example, similar advantageous effects can be obtained.

For still another example, when the terminal 20*a*-1 functions as a ground terminal, the terminal 20*a*-2 functions as a signal terminal, the terminal 20*b*-1 functions as a signal terminal, and the terminal 20*b*-2 functions as a ground terminal, in the configuration of the terminals at the one side ($X_1$ side) enclosed by dotted lines illustrated in FIG. 8, the signal terminal 20*b*-1 is arranged between the second ground terminal 40*b*-1 and the ground terminal 20*b*-2, and the shield plate 47 that functions as a ground by being coupled to the second ground terminal 40*b*-1 and the ground terminal 20*a*-1 are provided. Accordingly, occurrence of a crosstalk can be decreased. Also at the other side ($X_2$ side) enclosed by other dotted lines, when the configuration is similar to that of the above-described example, similar advantageous effects can be obtained.

Since the two shield plates 47 are coupled to the first ground terminal 40*a*-2 and the second ground terminal 40*b*-1, the number of parts that configure the connector can be decreased. It is not necessary to provide a mount portion that protrudes outside the side wall 6*a* or the side wall 6*b* of the housing 60 to mount the shield plates 47 on the substrate 4, and the high-density mounting and reduction in size of the parts of the connector can be attained.

Figure 9:
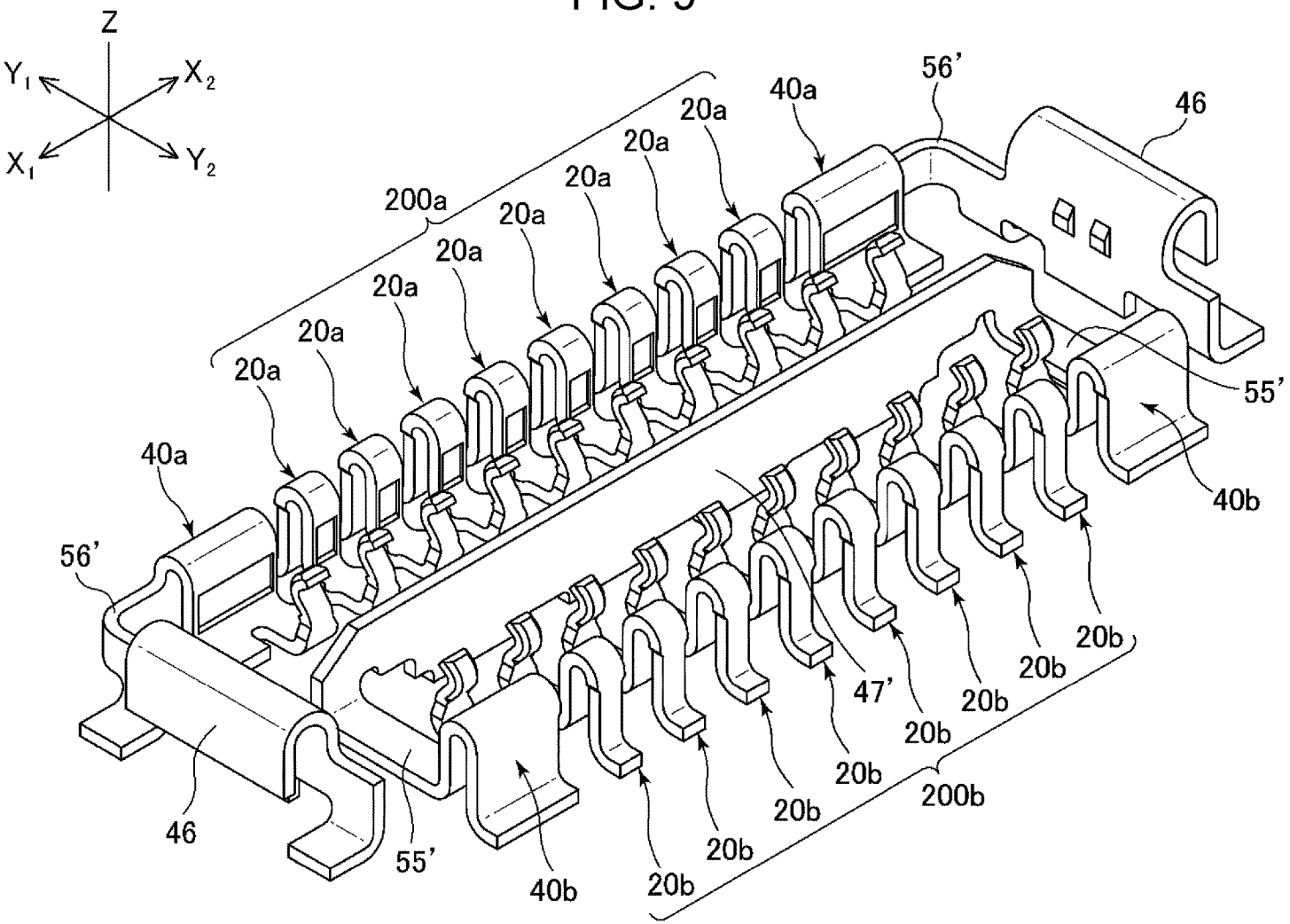
FIG. 9 is a perspective view illustrating terminal groups, ground terminals, a shield plate, and so forth, according to another embodiment of the present invention.
Figure 10:
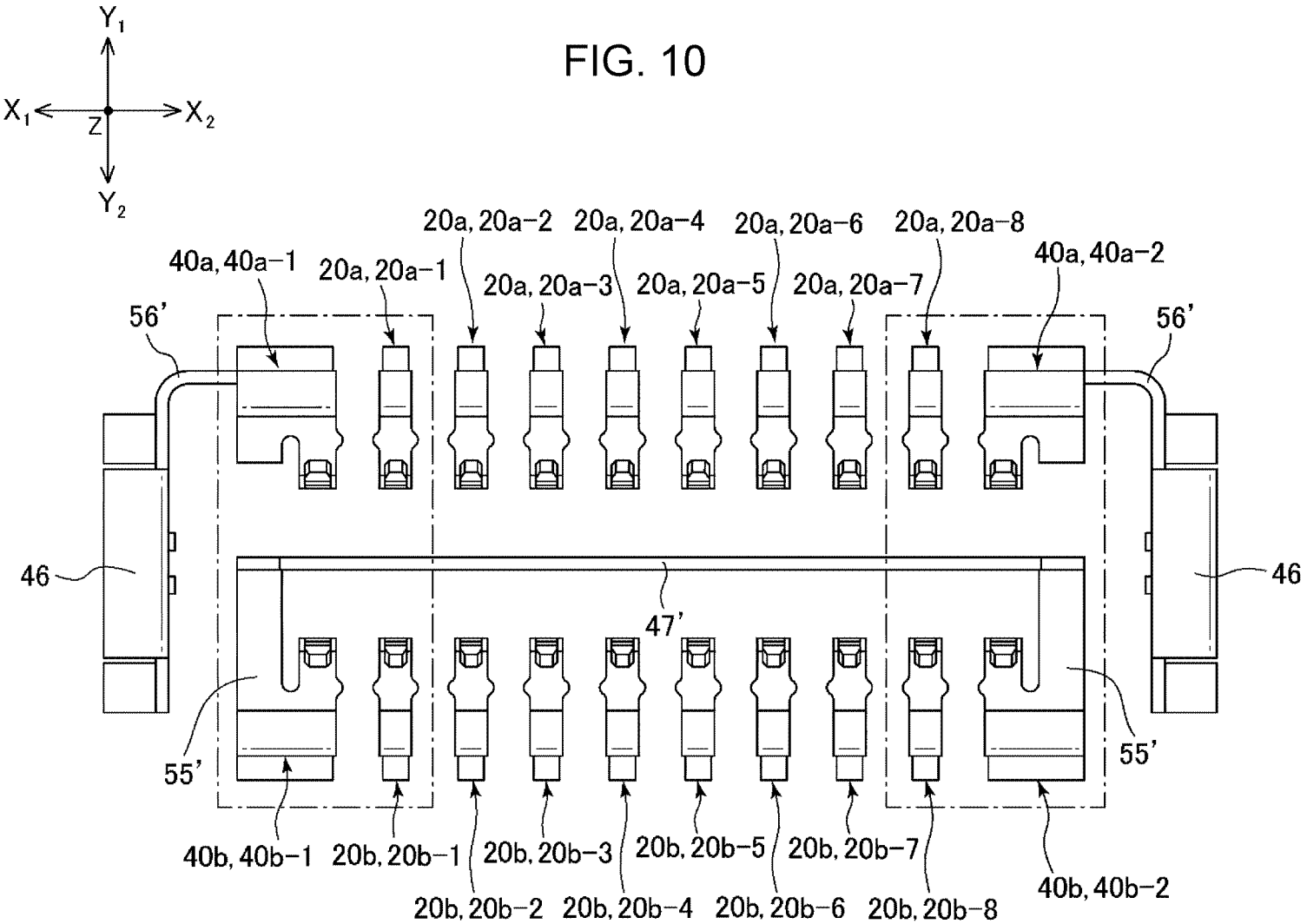
FIG. 10 is a top view illustrating the terminal groups, the ground terminals, the shield plate, and so forth, illustrated in FIG. 9.

FIG. 9 is a perspective view illustrating terminal groups, ground terminals, a shield plate, and so forth, according to another embodiment of the present invention. FIG. 10 is a top view illustrating the terminal groups, the ground terminals, the shield plate, and so forth, illustrated in FIG. 9. As illustrated in FIG. 10, similarly to FIG. 8, terminals of a first terminal group 200*a* and first ground terminals 40*a* are numbered from one side ($X_1$ side) toward the other side ($X_2$ side) in the long-side direction (X-axis direction) sequentially as a first ground terminal 40*a*-1, a terminal 20*a*-1 to a terminal 20*a*-8, and a first ground terminal 40*a*-2; and terminals of a second terminal group 200*b* and second ground terminals 40*b* are numbered from one side ($X_1$ side) toward the other side ($X_2$ side) in the long-side direction (X-axis direction) sequentially as a second ground terminal 40*b*-1, a terminal 20*b*-1 to a terminal 20*b*-8, and a first ground terminal 40*b*-2.

As illustrated in these drawings, a single shield plate 47' may be used. Both ends of the single shield plate 47' are coupled to the second ground terminal 40*b*-1 and the second ground terminal 40*b*-2 via coupling portions 55' configured to extend through a bottom portion of a housing 60. Also, the residual first ground terminal 40*a*-1 and first ground terminal 40*b*-2 not coupled to the shield plate 47' are coupled to reinforcing portions 46 via coupling portions 56' formed along corner portions of side walls of the housing 60.

The coupling target of the shield plate 47' is not limited to that according to the embodiment illustrated in FIGS. 9 and 10. The second ground terminal 40*b*-1 and the second ground terminal 40*b*-2 can be coupled to the reinforcing portions 46 via the coupling portions 56', and the first ground terminal 40*a*-1 and the first ground terminal 40*a*-2 can be coupled to the shield plate 47' via the coupling portions 55'. Also, one end (end at $X_1$ side) of the shield plate 47' can be coupled to at least one of the first ground terminal 40*a*-1 and the second ground terminal 40*b*-1, and the other end (end at $X_2$ side) of the shield plate 47' can be coupled to at least one of the first ground terminal 40*a*-2 and the second ground terminal 40*b*-2. For example, like the embodiment illustrated in FIGS. 7 and 8, the one end (end at $X_1$ side) of the shield plate 47' can be coupled to the second ground terminal 40*b*-1, and the other end (end at $X_2$ side) of the shield plate 47' can be coupled to the second ground terminal 40*a*-2.

When the configuration of the first ground terminal 40*a*-1 and the second ground terminal 40*b*-1 at the one side ($X_1$ side) and the terminal 20*a*-1 and the terminal 20*b*-1 adjacent thereto enclosed by dotted lines illustrated in FIG. 10 is similar to that of the example of the ground terminals and the signal terminals described in the embodiment illustrated in FIGS. 7 and 8, similar advantageous effects can be obtained. The configuration of the first ground terminal 40*a*-2 and the second ground terminal 40*b*-2 at the other side ($X_2$ side) and the terminal 20*a*-8 and the terminal 20*b*-8 adjacent thereto enclosed by dotted lines illustrated in FIG. 10 also provides similar advantageous effects. Also, with such a configuration, the number of parts that configure the connector can be decreased similarly to the embodiment illustrated in FIGS. 7 and 8, and the high-density mounting and reduction in size can be attained for parts of the connector etc.

Figure 11:
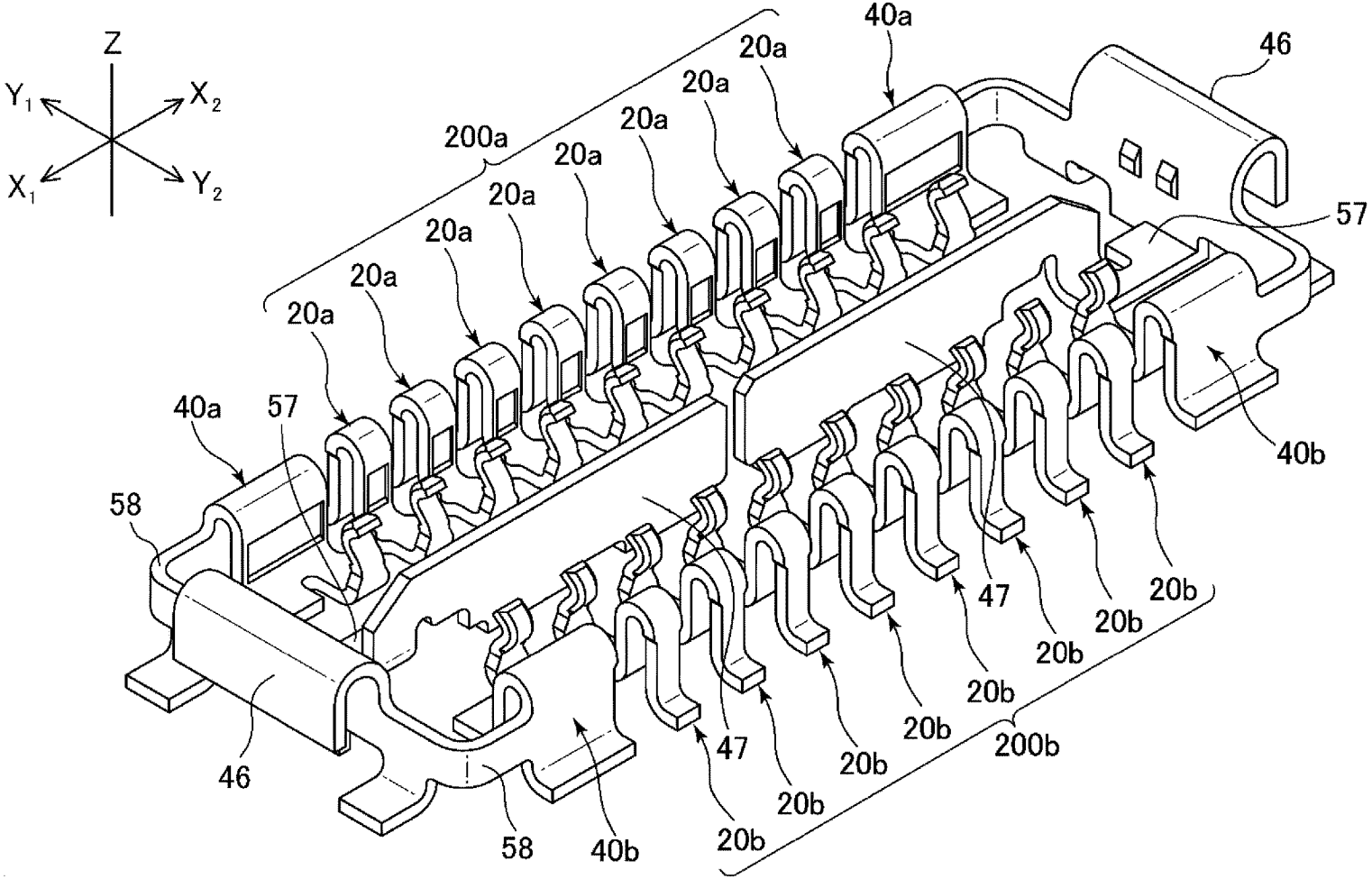
FIG. 11 is a perspective view illustrating terminal groups, ground terminals, shield plates, and so forth, according to still another embodiment of the present invention.
Figure 12:
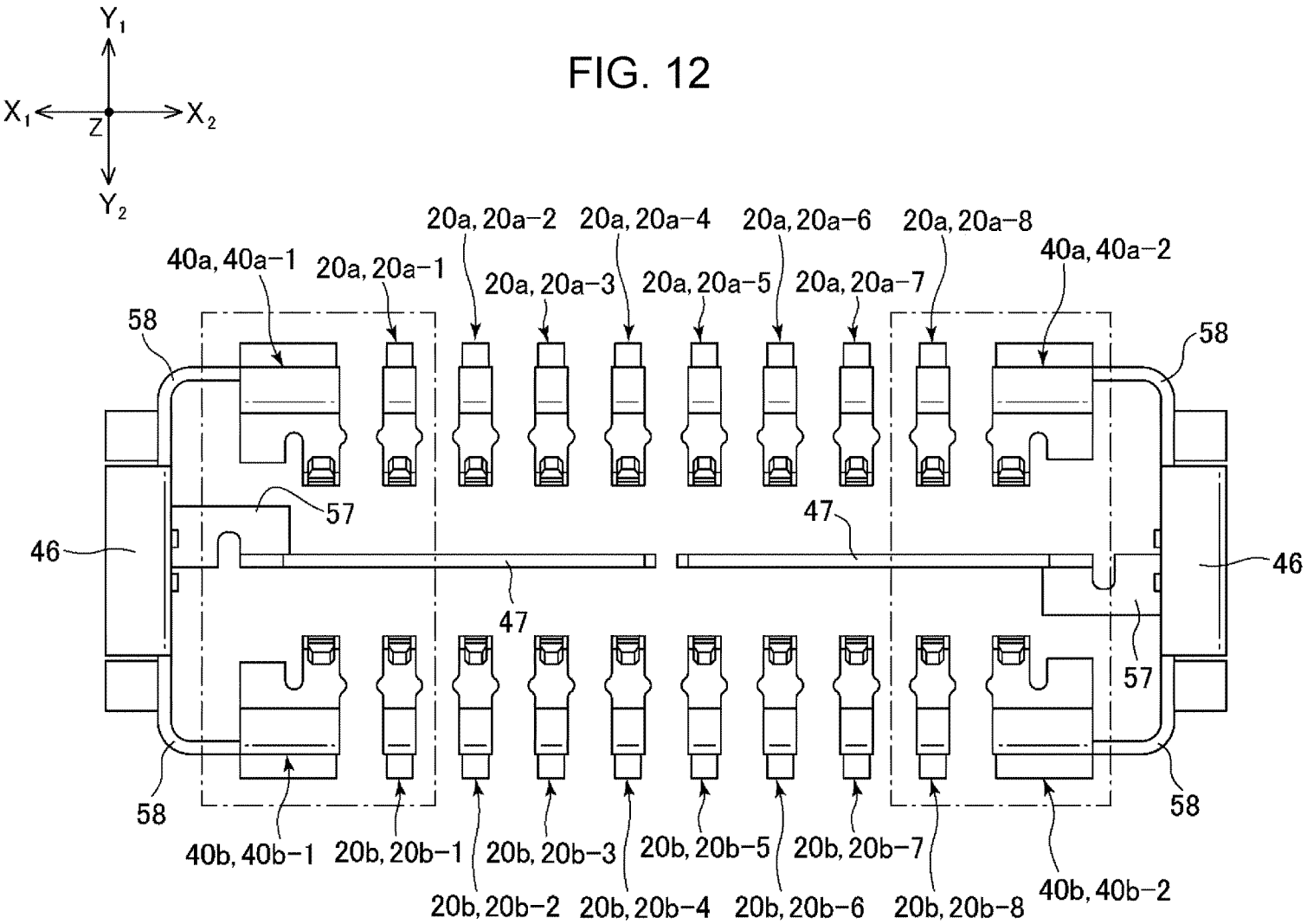
FIG. 12 is a top view illustrating the terminal groups, the ground terminals, the shield plates, and so forth, illustrated in FIG. 11.

FIG. 11 is a perspective view illustrating terminal groups, ground terminals, shield plates, and so forth, according to still another embodiment of the present invention. FIG. 12 is a top view illustrating the terminal groups, the ground terminals, the shield plates, and so forth, illustrated in FIG. 11. As illustrated in FIG. 12, similarly to FIGS. 8 and 10, terminals of a first terminal group 200*a* and first ground terminals 40*a* are numbered from one side ($X_1$ side) toward the other side ($X_2$ side) in the long-side direction (X-axis direction) sequentially as a first ground terminal 40*a*-1, a terminal 20*a*-1 to a terminal 20*a*-8, and a first ground terminal 40*a*-2; and terminals of a second terminal group 200*b* and second ground terminals 40*b* are numbered from the one side ($X_1$ side) toward the other side ($X_2$ side) in the long-side direction (X-axis direction) sequentially as a second ground terminal 40*b*-1, a terminal 20*b*-1 to a terminal 20*b*-8, and a second ground terminal 40*b*-2.

As illustrated in these drawings, the shield plate 47 at the one side ($X_1$ side) is coupled to a reinforcing portion 46 at the one side ($X_1$ side) via a coupling portion 57 configured to extend through a bottom portion of a housing 60, and the shield plate 47 at the other side ($X_2$ side) is coupled to a reinforcing portion 46 at the other side ($X_2$ side) via a coupling portion 57 likewise. Also, the first ground terminal 40*a*-1 and the second ground terminal 40*b*-1 provided at both sides adjacently to the reinforcing portion 46 at the one side ($X_1$ side) are coupled to the reinforcing portion 46 via coupling portions 58 formed along corner portions of side walls of the housing 60. Also, the first ground terminal 40*a*-2 and the second ground terminal 40*b*-2 provided at both sides adjacently to a reinforcing portion 46 at the other side ($X_2$ side) are configured likewise.

The coupling targets of the first ground terminals 40*a*-1 and 40*a*-2, and the second ground terminals 40*b*-1 and 40*b*-2 are not limited to those of the embodiment illustrated in FIGS. 11 and 12. At least one of the first ground terminal 40*a*-1 and the second ground terminal 40*b*-1 facing each other at the one side ($X_1$ side) may be coupled to the reinforcing portion 46 at the one side ($X_1$ side), and at least one of the first ground terminal 40*a*-2 and the second ground terminal 40*b*-2 facing each other at the other side ($X_2$ side) may be coupled to the reinforcing portion 46 at the other side ($X_2$ side). The first ground terminals 40*a*-1 and 40*a*-2, and the second ground terminals 40*b*-1 and 40*b*-2 may not be coupled to the reinforcing portions 46.

When the configuration of the first ground terminal 40*a*-1 and the second ground terminal 40*b*-1 at the one side ($X_1$ side) and the terminal 20*a*-1 and the terminal 20*b*-1 adjacent thereto enclosed by dotted lines illustrated in FIG. 12 is similar to that of the example of the ground terminals and the signal terminals described in the embodiment illustrated in FIGS. 7 and 8, similar advantageous effects can be obtained. Regarding the first ground terminal 40*a*-2 and the second ground terminal 40*b*-2 at the other side ($X_2$ side) and the terminal 20*a*-8 and the terminal 20*b*-8 adjacent thereto enclosed by dotted lines illustrated in FIG. 12, when such terminals have similar functions, similar advantageous effects can be obtained. Also, with such configurations, the number of parts that configure the connector can be decreased similarly to the embodiments illustrated in FIGS. 7 to 10, and the high-density mounting and reduction in size can be attained for parts of the connector etc.

As illustrated in FIGS. 1 to 8, and 11 and 12, since the two shield plates 47 are used, the number of the terminals 20*a* and the number of the terminals 20*b* of the receptacle connector 2 can be increased, and the connector size can be increased in the long-side direction (that is, the width can be increased). In a case where the terminals 20*a* and the terminals 20*b*, the first ground terminals 40*a* and the second ground terminals 40*b*, and the shield plates 47 that are used in the original connector are re-used, the terminals 20*a* and terminals 20*b* as well as the first ground terminal 40*a* and the second ground terminal 40*b* whose shapes do not have to be changed even when the width is increased, can be used without any change. However, the distance in the long-side direction (Y-axis direction) of the two shield plates 47 is increased, and there may be a portion where separation cannot be provided between the facing terminals 20*a* and terminals 20*b*. Even in this case, a problem such as occurrence of a crosstalk does not arise, as long as the terminals 20*a* and terminals 20*b* without separation by the shield plate 47 are designed not to be used for high-speed transmission of electric signals. According to the present invention, parts can be efficiently re-used as described above.

The individual examples of the present invention are not independent from one another, and may be appropriately combined and implemented.

The connector according to the present invention can be used in an electronic apparatus that performs high-speed transmission of electric signals, such as a smartphone or a cellular phone, for, for example, connecting substrates by a flat cable.

What is claimed is:

1. A connector comprising:

a first terminal group including a plurality of terminals;

a second terminal group including a plurality of terminals;

a first ground terminal;

a second ground terminal;

a housing that is made of insulating resin and that holds the first terminal group, the first ground terminal, the second terminal group, and the second ground terminal;

a shield plate arranged between the first terminal group and the second terminal group; and a plurality of reinforcing portions arranged at side walls in a short-side direction of the housing, wherein the plurality of terminals included in the first terminal group are arrayed in a long-side direction of the housing at one side, and the first ground terminal includes a plurality of first ground terminals arranged at both ends with the first terminal group interposed therebetween, wherein the plurality of terminals included in the second terminal group are arrayed in the long-side direction of the housing at the other side, and the second ground terminal includes a plurality of second ground terminals arranged at both ends with the second terminal group interposed therebetween, wherein the shield plate is coupled to at least one of the first ground terminals and the second ground terminals via a shield coupling portion, wherein a reinforcing portion among the plurality of reinforcing portions provided at one of the side walls is coupled to the first ground terminal at one side via a first reinforcing coupling portion, wherein a reinforcing portion among the plurality of reinforcing portions provided at another one of the side walls is coupled to the second ground terminal at the other side via a second reinforcing coupling portion, and wherein the first ground terminal and the second ground terminal coupled to the reinforcing portions are not coupled to the shield plate.

2. The connector according to claim 1, wherein a cross-sectional shape of a terminal included in the first terminal group when cut in a short-side direction of the housing is the same as a cross-sectional shape of each of the first ground terminals when cut in the short-side direction, and wherein a cross-sectional shape of a terminal included in the second terminal group when cut in the short-side direction of the housing is the same as a cross-sectional shape of each of the second ground terminals when cut in the short-side direction.

3. The connector according to claim 1, wherein the first terminal group, the first ground terminals, the second terminal group, the second ground terminals, the shield plate, and the shield coupling portion are formed by integrally molding with the housing.

4. The connector according to claim 1, wherein the shield plate includes two shield plates arranged in the long-side direction between the first terminal group and the second terminal group.

5. The connector according to claim 4, wherein a first shield plate of the two shield plates is coupled to at least one of the first ground terminals, and a second shield plate of the two shield plates is coupled to at least one of the second ground terminals.

6. The connector according to claim 4, wherein both the two shield plates are coupled to the first ground terminals or the second ground terminals.

7. The connector according to claim 1, wherein the shield plate is a single shield plate arranged in the long-side direction between the first terminal group and the second terminal group.

8. The connector according to claim 7, wherein one end of the shield plate is coupled to at least one of the first ground terminals, and the other end of the shield plate is coupled to at least one of the second ground terminals.

9. The connector according to claim 7, wherein both ends of the shield plate are coupled to the first ground terminals or the second ground terminals.

10. The connector according to claim 1, wherein the shield plate provides complete separation or partial separation between the plurality of terminals included in the first terminal group and the plurality of terminals included in the second terminal group.

11. The connector according to claim 1, wherein the shield plate is embedded in a fitting protrusion that is formed at a center portion to extend in the long-side direction of the housing.

12. The connector according to claim 1, wherein at least one of a terminal adjacent to the first ground terminal arranged at one side and a terminal adjacent to the second ground terminal facing the first ground terminal functions as a signal terminal.

13. The connector according to claim 1, wherein a terminal adjacent to the first ground terminal arranged at one side functions as a signal terminal, and a terminal adjacent to the second ground terminal facing the first ground terminal functions as a ground terminal.

14. A connector comprising:

a first terminal group including a plurality of terminals;

a second terminal group including a plurality of terminals;

a first ground terminal;

a second ground terminal;

a housing that is made of insulating resin and that holds the first terminal group, the first ground terminal, the second terminal group, and the second ground terminal;

a shield plate arranged between the first terminal group and the second terminal group; and a reinforcing portion arranged at a side wall in a short-side direction of the housing, wherein the plurality of terminals included in the first terminal group are arrayed in a long-side direction of the housing at one side, and the first ground terminal includes a plurality of first ground terminals arranged at both ends with the first terminal group interposed therebetween, wherein the plurality of terminals included in the second terminal group are arrayed in the long-side direction of the housing at the other side, and the second ground terminal includes a plurality of second ground terminals arranged at both ends with the second terminal group interposed therebetween, wherein the reinforcing portion includes a plurality of reinforcing portions provided at side walls extending in the short-side direction of the housing, wherein the shield plate is coupled to each of the reinforcing portions via a shield coupling portion, wherein each of the reinforcing portions is coupled to the first ground terminal and the second ground terminal adjacent to the reinforcing portion, via a reinforcing coupling portion.

15. The connector according to claim 14, wherein a cross-sectional shape of a terminal included in the first terminal group when cut in the short-side direction of the housing is the same as a cross-sectional shape of each of the first ground terminals when cut in the short-side direction, and wherein a cross-sectional shape of a terminal included in the second terminal group when cut in the short-side direction of the housing is the same as a cross-sectional shape of each of the second ground terminals when cut in the short-side direction.

16. The connector according to claim 14, wherein the first terminal group, the first ground terminals, the second terminal group, the second ground terminals, the shield plate, the reinforcing portions, and the shield coupling portions are formed by integrally molding with the housing.

* * * * *